US009177510B2

(12) United States Patent
Miyake

(10) Patent No.: US 9,177,510 B2
(45) Date of Patent: Nov. 3, 2015

(54) DRIVING METHOD FOR IRRADIATING COLORS OF A LIQUID CRYSTAL DISPLAY DEVICE

(75) Inventor: Hiroyuki Miyake, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 406 days.

(21) Appl. No.: 13/192,958

(22) Filed: Jul. 28, 2011

(65) Prior Publication Data

US 2012/0032996 A1 Feb. 9, 2012

(30) Foreign Application Priority Data

Aug. 5, 2010 (JP) ..... 2010-176027

(51) Int. Cl.
*G09G 3/36* (2006.01)
*G09G 3/34* (2006.01)

(52) U.S. Cl.
CPC ..... *G09G 3/3426* (2013.01); *G09G 3/3666* (2013.01); *G09G 3/3677* (2013.01); *G09G 2310/024* (2013.01); *G09G 2310/0235* (2013.01); *G09G 2320/0242* (2013.01)

(58) Field of Classification Search
CPC ..... G09G 3/22–3/288; G09G 2310/0235–10/0237; G09G 2320/045; G09G 2360/141
USPC ..... 345/87–104, 211–213
See application file for complete search history.

(56) References Cited

U.S. PATENT DOCUMENTS

| | | | | |
|---|---|---|---|---|
| 6,115,017 | A | 9/2000 | Mikami et al. | |
| 6,327,008 | B1 * | 12/2001 | Fujiyoshi | 349/106 |
| 6,448,951 | B1 | 9/2002 | Sakaguchi et al. | |
| 6,597,348 | B1 | 7/2003 | Yamazaki et al. | |
| 7,317,438 | B2 | 1/2008 | Yamazaki et al. | |
| 7,385,579 | B2 | 6/2008 | Satake | |
| 7,403,177 | B2 | 7/2008 | Tanada et al. | |

(Continued)

FOREIGN PATENT DOCUMENTS

| | | | |
|---|---|---|---|
| JP | 2003-255912 | A | 9/2003 |
| JP | 2006-220685 | A | 8/2006 |

(Continued)

OTHER PUBLICATIONS

Baron.P. et al., "36.4: Can Motion Compensation Eliminate Color Breakup of Moving Objects in Field-Sequential Color Displays?,", SID Digest '96 : SID International Symposium Digest of Technical Papers, 1996, vol. 27, pp. 843-846.

(Continued)

*Primary Examiner* — Sanghyuk Park
(74) *Attorney, Agent, or Firm* — Eric J. Robinson; Robinson Intellectual Property Law Office, P.C.

(57) ABSTRACT

In the first range of a screen, an image signal is input to a plurality of pixels arranged in the first region, and next an image signal is input to a plurality of pixels arranged in the second region that is adjacent to one side of the first region, and light of the first color is delivered every time the input of the image signal is finished. Further, in the second range, an image signal is input to a plurality of pixels arranged in a fourth region; next, an image signal is input to a plurality of pixels arranged in a third region adjacent to the other side of the fourth region, and light of a second color is delivered every time the input of the image signal is finished.

12 Claims, 20 Drawing Sheets

(56) References Cited

U.S. PATENT DOCUMENTS

| | | | | |
|---|---|---|---|---|
| 7,728,810 | B2 | 6/2010 | You et al. | |
| 7,773,066 | B2 | 8/2010 | Yamazaki et al. | |
| 7,791,571 | B2 | 9/2010 | Ohtani et al. | |
| 7,834,830 | B2 | 11/2010 | Yamazaki et al. | |
| 7,855,770 | B2 | 12/2010 | Egi et al. | |
| 8,426,866 | B2 | 4/2013 | Kimura et al. | |
| 8,766,906 | B2 | 7/2014 | Yoshida et al. | |
| 2002/0018029 | A1 | 2/2002 | Koyama | |
| 2002/0024485 | A1 | 2/2002 | Koyama | |
| 2004/0095305 | A1 | 5/2004 | Kimura et al. | |
| 2004/0222955 | A1 | 11/2004 | Koyama | |
| 2006/0187179 | A1* | 8/2006 | Karman et al. | 345/102 |
| 2006/0262079 | A1* | 11/2006 | Seong et al. | 345/102 |
| 2007/0057904 | A1 | 3/2007 | Huang et al. | |
| 2007/0120810 | A1 | 5/2007 | You et al. | |
| 2007/0279352 | A1* | 12/2007 | Tanaka | 345/87 |
| 2007/0279359 | A1 | 12/2007 | Yoshida et al. | |
| 2007/0279374 | A1 | 12/2007 | Kimura et al. | |
| 2008/0001906 | A1* | 1/2008 | Wang | 345/102 |
| 2008/0024418 | A1 | 1/2008 | Kim | |
| 2008/0158137 | A1 | 7/2008 | Yoshida | |
| 2008/0180385 | A1 | 7/2008 | Yoshida et al. | |
| 2009/0051674 | A1 | 2/2009 | Kimura et al. | |
| 2009/0058795 | A1* | 3/2009 | Yamazaki | 345/102 |
| 2009/0073100 | A1 | 3/2009 | Kim et al. | |
| 2009/0135129 | A1* | 5/2009 | Roth et al. | 345/102 |
| 2009/0267878 | A1 | 10/2009 | Song et al. | |
| 2009/0273555 | A1 | 11/2009 | Song et al. | |
| 2009/0273557 | A1 | 11/2009 | Song et al. | |
| 2009/0289964 | A1 | 11/2009 | Miyachi | |
| 2010/0103089 | A1* | 4/2010 | Yoshida et al. | 345/102 |
| 2010/0134398 | A1 | 6/2010 | Toyota et al. | |
| 2010/0134451 | A1 | 6/2010 | Cho et al. | |
| 2010/0156964 | A1* | 6/2010 | Masuda et al. | 345/691 |
| 2010/0188439 | A1* | 7/2010 | Sugimoto et al. | 345/690 |
| 2010/0225615 | A1 | 9/2010 | Kurokawa | |
| 2010/0265222 | A1* | 10/2010 | Tsuboi et al. | 345/205 |
| 2010/0289883 | A1* | 11/2010 | Goris et al. | 348/56 |
| 2010/0321420 | A1 | 12/2010 | Ohtani et al. | |
| 2011/0001725 | A1 | 1/2011 | Kurokawa | |
| 2011/0025729 | A1 | 2/2011 | Yamazaki et al. | |
| 2011/0051034 | A1 | 3/2011 | Egi et al. | |
| 2011/0248970 | A1 | 10/2011 | Koyama et al. | |
| 2011/0248978 | A1 | 10/2011 | Koyama et al. | |
| 2011/0249037 | A1 | 10/2011 | Koyama et al. | |
| 2011/0292088 | A1 | 12/2011 | Toyotaka et al. | |
| 2011/0310132 | A1 | 12/2011 | Kurokawa et al. | |
| 2011/0310133 | A1 | 12/2011 | Koyama et al. | |
| 2011/0316818 | A1 | 12/2011 | Koyama et al. | |
| 2012/0001953 | A1 | 1/2012 | Hirakata et al. | |
| 2012/0001954 | A1 | 1/2012 | Yamazaki et al. | |
| 2012/0001955 | A1 | 1/2012 | Yamazaki et al. | |
| 2012/0002127 | A1 | 1/2012 | Yamazaki et al. | |
| 2012/0002132 | A1 | 1/2012 | Yamazaki et al. | |
| 2012/0002133 | A1 | 1/2012 | Yamazaki et al. | |
| 2012/0019567 | A1 | 1/2012 | Yamazaki et al. | |
| 2014/0139568 | A1 | 5/2014 | Yoshida et al. | |

FOREIGN PATENT DOCUMENTS

| | | | |
|---|---|---|---|
| JP | 2007-264211 | A | 10/2007 |
| JP | 2009-042405 | A | 2/2009 |
| JP | 2009-053594 | A | 3/2009 |
| JP | 2009-115968 | A | 5/2009 |

OTHER PUBLICATIONS

Kurita.T et al., "Evaluation and Improvement of Picture Quality for Moving Images on Field-sequential Color Displays,", IDW '00 : Proceedings of the 17TH International Display Workshops, 2000, pp. 69-72.

Taira.K et al., "A15" Field-Sequential Display without Color Break-Up using an AFLC Color Shutter,, IDW '00 : Proceedings of the 17TH International Display Workshops, 2000, pp. 73-76.

Jarvenpaa.T, "7.2: Measuring Color Breakup of Stationary Images in Field-Sequential-Color Displays,", SID Digest '04 : SID International Symposium Digest of Technical Papers, 2004, vol. 35, pp. 82-85.

* cited by examiner

DRIVING METHOD FOR IRRADIATING COLORS OF A LIQUID CRYSTAL DISPLAY DEVICE

BACKGROUND OF THE INVENTION

1. Field of the Invention

The present invention relates to driving methods of liquid crystal display devices. In particular, the present invention relates to driving methods of field-sequential liquid crystal display devices.

2. Description of the Related Art

As display methods of liquid crystal display devices, a color filter method and a field sequential method are known. In a color-filter liquid crystal display device, a plurality of subpixels which has color filters for transmitting only light of wavelengths with given colors (e.g., red (R), green (G), and blue (B)) is provided in each pixel. A desired color is expressed by control of transmission of white light in each subpixel and mixture of a plurality of colors in each pixel. In contrast, in a field-sequential liquid crystal display device, a plurality of light sources that emit lights of different colors (e.g., red (R), green (G), and blue (B)) are provided. A desired color is expressed by on/off of the plurality of light sources that emit lights of different colors and control of transmission of light of different colors in each pixel. In other words, the color filter method is a method by which a desired color is expressed by division of an area according to lights of given colors, and the field sequential method is a method by which a desired color is expressed by time-division according to lights of given colors.

The field-sequential liquid crystal display device has the following advantages over the color-filter liquid crystal display device. First, in the field-sequential liquid crystal display device, it is not necessary to provide subpixels in each pixel. Thus, the aperture ratio can be increased or the number of pixels can be increased. Second, in the field-sequential liquid crystal display device, it is not necessary to provide color filters. In other words, light loss caused by light absorption in the color filters does not occur. Therefore, transmittance can be improved and power consumption can be reduced.

Patent Document 1 discloses a field-sequential liquid crystal display device. Specifically, Patent Document 1 discloses a liquid crystal display device in which each pixel includes a transistor for controlling input of an image signal, a signal storage capacitor for holding the image signal, and a transistor for controlling transfer of an electrical charge from the signal storage capacitor to a display pixel capacitor. In the liquid crystal display device with the structure, input of an image signal to the signal storage capacitor and display based on an electrical charge held in the display pixel capacitor can be performed concurrently.

REFERENCE

Patent Document 1: Japanese Published Patent Application No. 2009-42405

SUMMARY OF THE INVENTION

As described above, in the field-sequential liquid crystal display device, color information is time-divided. For that reason, display perceived by a user is sometimes changed (degraded) from display based on original display information (such a phenomenon is also referred to as color breaks) because of a lack of a given piece of display information due to temporary interruption of display, such as a blink of the user or an overload of specific display information associated with the movement of the viewpoint.

Thus, an object of one embodiment of the present invention is to suppress a decrease in image quality of a field-sequential liquid crystal display device.

A pixel portion having a plurality of pixels which control transmission of light in a liquid crystal display device is divided into a plurality of regions having the plurality of pixels and a plurality of ranges having the plurality of regions. First, an image signal is input to a plurality of pixels arranged in a first region. After the image signal is input to the first region, an image signal is input to a plurality of pixels arranged in a second region that is adjacent to one side of the first region. In addition, each region is irradiated with light of a first color every time the input of the image signal to each region is finished. A plurality of consecutive regions is driven in this manner, and a field sequential method is applied to each region, whereby an image can be displayed on the liquid crystal display device. Note that it is perceived by a user of the display device that an image is drawn while the light of the first color moves from the first region to the second region.

In a display device driven in such a manner, the inventor focuses on a fact that color break is remarkably recognized in the case where a direction along which a region irradiated with light of a given color moves and a direction of the movement of eyes relatively correspond to each other.

In the field sequential method, an image is time-divided into light of different colors and a color image is displayed by controlling transmission of each light. Therefore, when a user moves the user's line of sight, the light of the first color comes into sight for a longer period than light of another color. As a result, the user perceives display which is changed (degraded) from display based on original display information.

Thus, a first range and a second range are arranged in a pixel portion of a liquid crystal display device. In the first range, an image signal is input to a plurality of pixels arranged in a first region; next, an image signal is input to a plurality of pixels arranged in a second region that is adjacent to one side of the first region (e.g., on a side of a larger row number). Each region is irradiated with light of the first color every time the input of the image signal to each region is finished. Further, in the second range, an image signal is input to a plurality of pixels arranged in a fourth region; next, an image signal is input to a plurality of pixels arranged in a third region adjacent to the other side of the fourth region (e.g., on a side of a smaller row number). Each region is irradiated with light of the first color or light of a color different from the first color every time the input of the image signal to each region is finished. The liquid crystal display device may be driven in such a way that the pixel portion is divided into a plurality of ranges and an image is drawn while light of the first color and light of the first color or light of a color different from the first color move in the opposing direction in this manner.

In other words, one embodiment of the present invention is a driving method of a liquid crystal display device which includes a backlight panel including a plurality of light sources that emits light of different colors and is repeatedly turned on and off and a plurality of pixels that is configured to control transmission of light and arranged in a matrix of m rows and n columns (m and n are natural numbers greater than or equal to 4) in front of the backlight panel. The driving method according to one embodiment of the present invention relates to a period during which an image signal for controlling transmission of light of a first color is input to a first range where pixels of a first row to an A-th row (A is a natural number less than or equal to m/2) are arranged and an image signal for controlling transmission of light of a second color is input to a second range where pixels of a (A+1)-th row to a 2A-th row are arranged. Specifically, the driving method of a liquid crystal display device includes the following steps: irradiating a first region with the light of the first color and inputting an image signal for controlling transmission of the light of the first color to a second region where pixels of a (B+1)-th row to a 2B-th (B is a natural number less than or equal to A/2) row are arranged after inputting an image signal for controlling transmission of the light of the first color to the first region where pixels of the first row to a B-th row are arranged; and irradiating a fourth region with the light of the second color and inputting an image signal for controlling transmission of the light of the second color to a third region where pixels of a (2A−2B+1)-th row to a (2A−B)-th row are arranged after inputting an image signal for controlling transmission of the light of the second color to the fourth region where pixels of a (2A−B+1)-th row to the 2A-th row are arranged.

According to the above-described one embodiment of the present invention, it is perceived by a user that an image is drawn while the light of the first color moves from the first region to the second region in the first range. As a result, when the user moves the user's line of sight from the first region to the second region, an image drawn by the light of the first color is observed for a longer period than an image drawn by light of another color. In contrast, it is perceived that an image is drawn while the light of the second color moves from the fourth region to the third region in the second range. As a result, when the user moves the user's line of sight from the fourth region to the third region, an image drawn by the light of the second color is observed for a longer period than light of another color.

A pixel portion of the liquid crystal display device according to one embodiment of the present invention is provided with the first range and the second range which are in contact with each other. Therefore, in the case where the line of sight moves from the first region to the second region, an image drawn by the light of the first color is observed for a long period while the line of sight moves in the first range. However, when the line of sight enters the second range, an image drawn by light of all the colors does not correspond to the movement of the line of sight; therefore, an entire image drawn by light of all the colors is observed. Similarly, in the case where the line of sight moves from the fourth region to the third region, an image drawn by the light of the second color is observed for a long period while the line of sight moves in the second range. However, when the line of sight enters the first range, an image drawn by light of all the colors does not correspond to the movement of the line of sight; therefore, an entire image drawn by light of all the colors is observed.

In this manner, a range in which an image is drawn while light of a given color moves in one direction is divided by a range in which an image is drawn while light of the same color or light of a color different from the given color moves in a direction opposed to the one direction, whereby a period in which the light of the given color continuously comes into the sight of the user can be decreased or the range can be narrowed. With such a structure, the period of time in which display information including the light of the given color is perceived excessively by the user or the range can be reduced, and a decrease in the display quality perceived by the user can be suppressed.

In particular, in the case where the pixel portion accounts for a wide range of sight, for example, in a large-sized display device or the like, the range in which the light of the given color continuously comes into the sight of the user can be narrowed. As a result, a decrease in the display quality perceived by the user can be suppressed and the image quality can be improved.

In addition, one embodiment of the present invention is a driving method of a liquid crystal display device which includes a backlight panel including a plurality of light sources that emits light of different colors and is repeatedly turned on and off and a plurality of pixels that is configured to control transmission of light and arranged in a matrix of m rows and n columns (m and n are natural numbers greater than or equal to 4) in front of the backlight panel. The driving method according to one embodiment of the present invention relates to a period during which an image signal for controlling transmission of light of a first color is input to a plurality of pixels arranged in a first range including a first row to an A-th row (A is a natural number less than or equal to m/2) and an image signal for controlling transmission of light of a second color is input to a plurality of pixels arranged in a second range including a (A+1)-th row to a 2A-th row. Specifically, the driving method according to one embodiment of the present invention includes: a first step of inputting an image signal for controlling transmission of light to a plurality of pixels of the first row to a B-th (B is a natural number less than or equal to A/2) row arranged in a first region and a plurality of pixels of a (2A−B+1)-th row to a 2A-th row arranged in a fourth region; a second step of irradiating the first region with the light of the first color and the fourth region with the light of the second color at the same time and inputting an image signal for controlling transmission of light to a plurality of pixels of a (B+1)-th row to a 2B-th row arranged in the second region and a plurality of pixels of a (2A−2B+1)-th row to a (2A−B)-th row arranged in the third region, after the first step. The driving method according to one embodiment of the present invention further includes a third step of irradiating the second region with the light of the first color and the third region with the light of the second color at the same time after the second step.

In this manner, a range in which an image is drawn while light of a first color moves in one direction is divided by a range in which an image is drawn while light of the same color or light of a color different from the first color moves in a direction opposed to the one direction, whereby a period in which the light of the first color continuously comes into the sight of the user can be decreased or the range can be narrowed. With such a structure, overload of specific display information can be prevented, and a decrease in the display quality perceived by the user can be suppressed, whereby the quality of a display image can be improved.

In particular, in the case where the pixel portion accounts for a wide range of sight, like in a large-sized display device, the range in which the light of the given color continuously comes into the sight of the user can be narrowed. As a result, a decrease in the display quality perceived by the user can be suppressed and the image quality can be improved.

One embodiment of the present invention is the above-described driving method of a liquid crystal display device, in which the light of the first color and the light of the second color are light of the same color.

When such a method is used, light of the same color is delivered to the A-th row and the (A+1)-th row; therefore, a phenomenon in which light of different colors emitted from the backlight panel is mixed in the pixel portion of the liquid crystal display device can be prevented.

In the liquid crystal display device according to one embodiment of the present invention, image signal input and the turning on of backlights are not sequentially performed in the entire pixel portion but can be sequentially performed per specific region of the pixel portion. Thus, it is possible to increase the frequency of input of an image signal to each pixel of the liquid crystal display device, for example. Accordingly, deterioration of display such as color break or the like generated in the liquid crystal display device can be suppressed, and the image quality can be improved.

In addition, a range in which an image is drawn while light of a given color moves in one direction is divided by a range in which an image is drawn while light of the same color or light of a color different from the given color moves in a direction opposed to the one direction, whereby a period in which the light of the given color continuously comes into the sight of the user can be decreased or the range can be narrowed. With such a structure, overload of specific display information can be prevented, and a decrease in the display quality perceived by the user can be suppressed, whereby the quality of a display image can be improved.

DETAILED DESCRIPTION OF THE INVENTION

Figure 1:
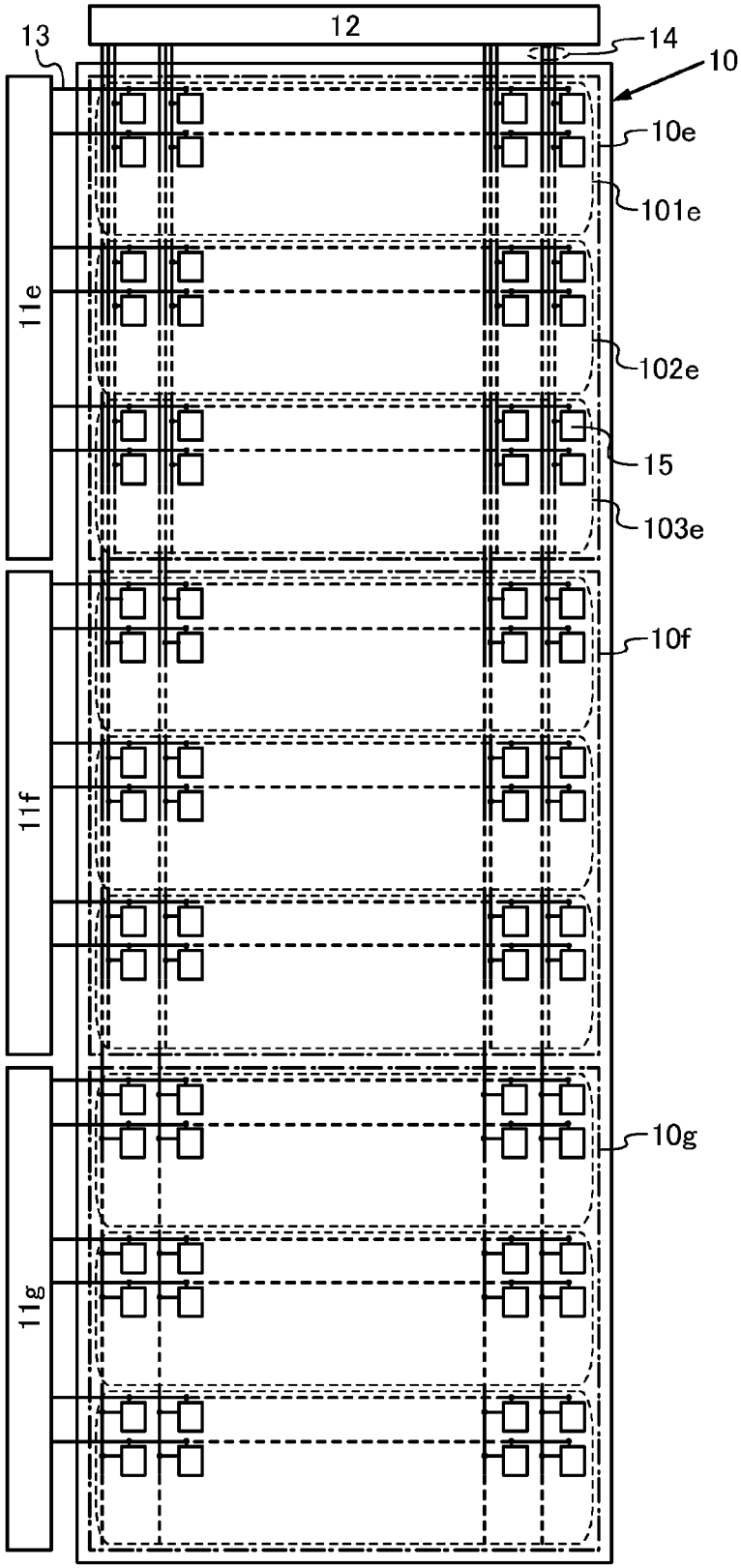
FIG. 1 illustrates a structure example of a liquid crystal display device.

Embodiments will be described in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be limited to the descriptions of the embodiments below. Note that in the structures of the present invention described below, the same portions or portions having similar functions are denoted by the same reference numerals in different drawings, and description of such portions is not repeated.

(Embodiment 1)

In this embodiment, a liquid crystal display device according to one embodiment of the present invention will be described with reference to FIG. 1, FIG. 2, FIGS. 3A to 3C, FIGS. 4A to 4C, FIGS. 5A to 5D, FIGS. 6A to 6C, FIGS. 7A to 7C, FIG. 8, FIG. 9, FIG. 10, FIG. 11, FIG. 12, FIGS. 13A and 13B, and FIGS. 14A and 14B.

<Structure Example of Liquid Crystal Display Device>

FIG. 1 illustrates a structure example of a liquid crystal display device. The liquid crystal display device illustrated in FIG. 1 includes a pixel portion 10, a scan line driver circuit 11, a signal line driver circuit 12, m scan lines 13 which are arranged parallel (or substantially parallel) to each other and whose potentials are controlled by the scan line driver circuit 11, and 3n signal lines 14 which are arranged parallel (or substantially parallel) to each other and whose potentials are controlled by the signal line driver circuit 12.

The pixel portion 10 is divided into three ranges (ranges 10*e* to 10*g*), and pixels are arranged in a matrix of e rows and n columns in the range 10*e*; pixels are arranged in a matrix off rows and n columns in the range 10*f*; and pixels are arranged in a matrix of g rows and n columns in the range 10*g*. Further, each range is divided into three regions. For example, the range 10*e* is divided into regions 101*e* to 103*e*.

Each of the scan lines 13 is electrically connected to n pixels arranged in a given row among the plurality of pixels arranged in m rows and n columns in the pixel portion 10. Further, the n signal lines 14 of the 3n signal lines 14 are electrically connected to e pixels arranged in any column of a plurality of pixels arranged in the range 10*e*; another n signal lines 14 are electrically connected to f pixels arranged in any column of a plurality of pixels arranged in the range 10*f*; and the other n signal lines 14 are electrically connected to g pixels arranged in any column of a plurality of pixels arranged in the range 10*g*. In other words, the sum of e, f, and g is equal to m (e+f+g=m).

Figure 2:
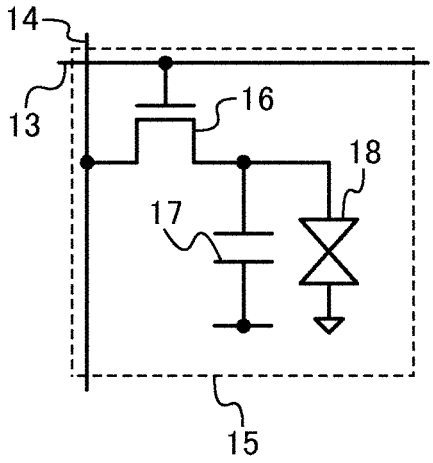
FIG. 2 illustrates a structure example of a pixel.

FIG. 2 illustrates an example of a circuit diagram of a pixel 15 included in the liquid crystal display device illustrated in FIG. 1. The pixel 15 in FIG. 2 includes a transistor 16, a capacitor 17, and a liquid crystal element 18. A gate of the transistor 16 is electrically connected to the scan line 13, and one of a source and a drain of the transistor 16 is electrically connected to the signal line 14. One of electrodes of the capacitor 17 is electrically connected to the other of the source and the drain of the transistor 16, and the other of the electrodes of the capacitor 17 is electrically connected to a wiring for supplying a capacitor potential (the wiring is also referred to as a capacitor wiring). One of electrodes (also referred to as a pixel electrode) of the liquid crystal element 18 is electrically connected to the other of the source and the drain of the transistor 16 and one of the electrodes of the capacitor 17, and the other of the electrodes (also referred to as a counter electrode) of the liquid crystal element 18 is electrically connected to a wiring for supplying a counter potential. The transistor 16 is an n-channel transistor. The capacitor potential and the counter potential can be the same potential.

Next, structure examples of a scan line driver circuit 11*e*, a scan line driver circuit 11*f*, and a scan line driver circuit 11*g* will be described. The scan line driver circuit 11*e* outputs a selection signal to the pixels sequentially through the scan line 13_1 in the first row to the scan line 13_*e* in the e-th row. Further, the scan line driver circuit 11*f* outputs a selection signal to the pixels sequentially through the scan line 13_(*e*+*f*) in the (e+f)-th row to the scan line 13_(*e*+1) in the (e+1)-th row. In addition, the scan line driver circuit 11*g* outputs a selection signal to the pixels sequentially through the scan line 13_(*e*+*f*+1) in the (e+f+1)-th row to the scan line 13_*m* in the m-th row. In other words, the scan line driver circuit 11*f* has a structure in which a shift direction is opposed to those of the scan line driver circuit 11*e* and the scan line driver circuit 11*g*.

<Structure Example of Scan Line Driver Circuit 11*e*>

Figure 3A:
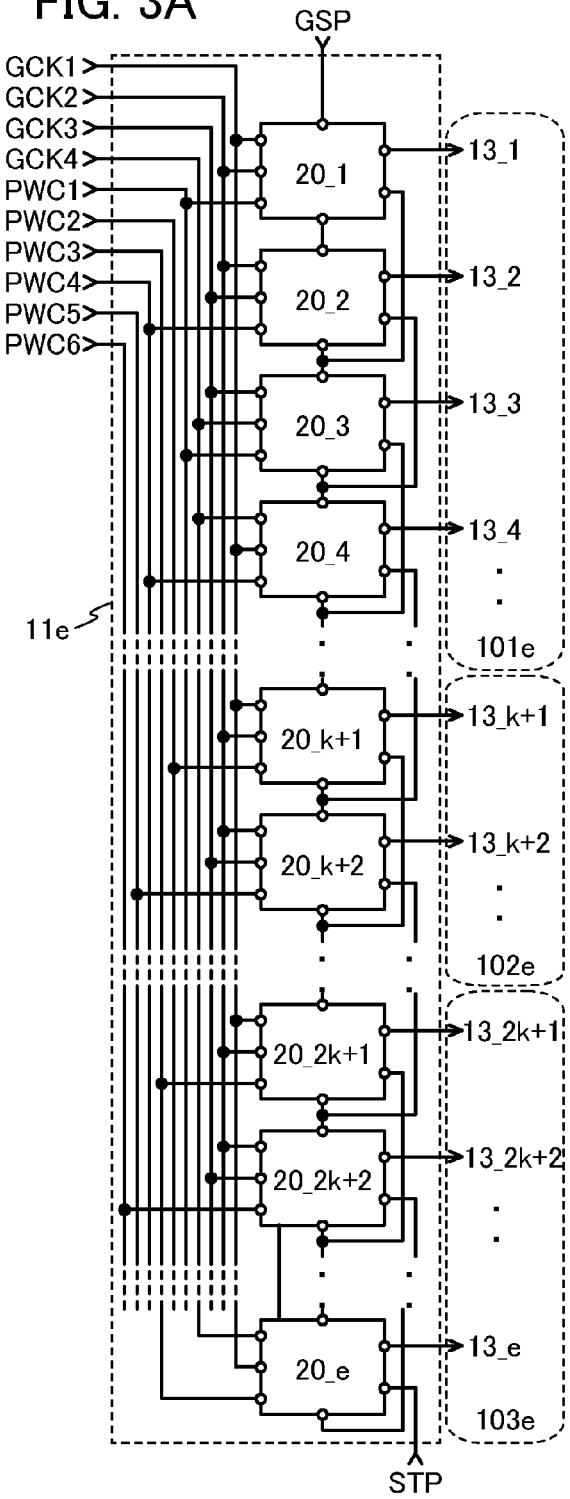
FIG. 3A illustrates a structure example of a scan line driver circuit.

FIG. 3A illustrates a structure example of the scan line driver circuit 11*e* included in the liquid crystal display device in FIG. 1. Note that in this embodiment, a scan line driver circuit whose structure is similar to that of the scan line driver circuit 11*e* is used for the scan line driver circuit 11*g*, and detailed description is omitted. The scan line driver circuit 11*e* illustrated in FIG. 3A includes: respective wirings for supplying first to fourth clock signals (GCK1 to GCK4) for the scan line driver circuit; respective wirings for supplying first to sixth pulse-width control signals (PWC1 to PWC6); and a first pulse output circuit 20_1 which is electrically connected to the scan line 13 in the first row to an e-th pulse output circuit 20_*e* which is electrically connected to the scan line 13 in the e-th row. Note that here, the first pulse output circuit 20_1 to the k-th pulse output circuit 20_*k* (k is less than e/2 and a multiple of 4) are electrically connected to the scan lines 13 provided for the region 101*e*; the (k+1)-th pulse output circuit 20_(*k*+1) to the 2k-th pulse output circuit 20_2k are electrically connected to the scan lines 13 provided for the region 102*e*; and the (2k+1)-th pulse output circuit 20_(2k+1) to the e-th pulse output circuit 20_*e* are electrically connected to the scan lines 13 provided for the region 103*e*. The first pulse output circuit 20_1 to the e-th pulse output circuit 20_*e* are configured to shift a shift pulse sequentially per shift period in response to a start pulse (GSP) for the scan line driver circuit which is input to the first pulse output circuit 20_1. Note that a plurality of shift pulses can be shifted in parallel in the first pulse output circuit 20_1 to the e-th pulse output circuit 20_*e*. In other words, even in a period in which a shift pulse is shifted in the first pulse output circuit 20_1 to the e-th pulse output circuit 20_*e*, the start pulse (GSP) for the scan line driver circuit can be input to the first pulse output circuit 20_1.

Figure 3B:
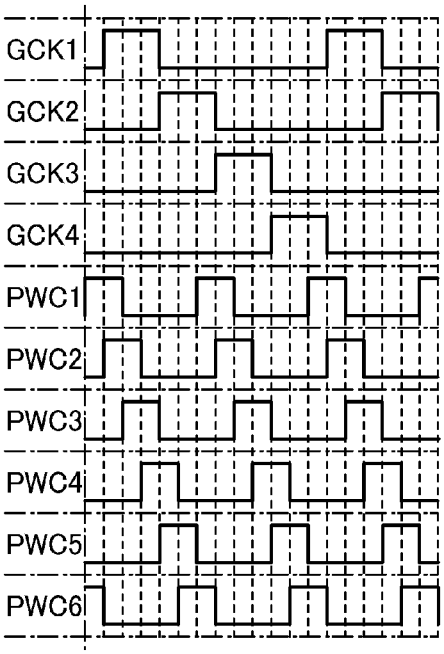
FIG. 3B is a timing diagram illustrating an example of a signal used for the scan line driver circuit.
Figure 3C:
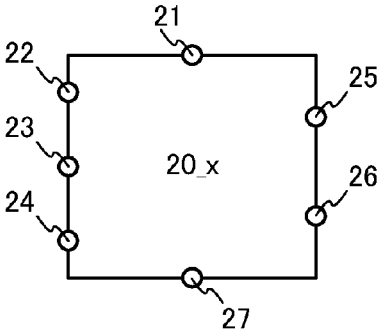
FIG. 3C illustrates a structure example of a pulse output circuit.

FIG. 3B illustrates examples of specific waveforms of the above-described signals. The first clock signal (GCK1) for the scan line driver circuit in FIG. 3B periodically repeats a high-level potential (high power supply potential (Vdd)) and a low-level potential (low power supply potential (Vss)), and has a duty ratio of 1/4. The second clock signal (GCK2) for the scan line driver circuit is a signal whose phase is deviated by 1/4 period from the first clock signal (GCK1) for the scan line driver circuit; the third clock signal (GCK3) for the scan line driver circuit is a signal whose phase is deviated by 1/2 period from the first clock signal (GCK1) for the scan line driver circuit; and the fourth clock signal (GCK4) for the scan line driver circuit is a signal whose phase is deviated by 3/4 period from the first clock signal (GCK1) for the scan line driver circuit. The first pulse-width control signal (PWC1) periodically repeats the high-level potential (high power supply potential (Vdd)) and the low-level potential (low power supply potential (Vss)), and has a duty ratio of 1/3. The second pulse-width control signal (PWC2) is a signal whose phase is deviated by 1/6 period from the first pulse-width control signal (PWC1); the third pulse-width control signal (PWC3) is a signal whose phase is deviated by 1/3 period from the first pulse-width control signal (PWC1); the fourth pulse-width control signal (PWC4) is a signal whose phase is deviated by 1/2 period from the first pulse-width control signal (PWC1); the fifth pulse-width control signal (PWC5) is a signal whose phase is deviated by 2/3 period from the first pulse-width control signal (PWC1); and the sixth pulse-width control signal (PWC6) is a signal whose phase is deviated by 5/6 period from the first pulse-width control signal (PWC1). Note that here, the ratio of the pulse width of each of the first to fourth clock signals (GCK1 to GCK4) for the scan line driver circuit, to the pulse width of each of the first to sixth pulse-width control signals (PWC1 to PWC6) is 3:2.

In the above-described liquid crystal display device, the same configuration can be applied to the first pulse output circuit 20_1 to the e-th pulse output circuit 20_*e*. However, electrical connections of a plurality of terminals included in the pulse output circuit differ depending on the pulse output circuits. Specific connection relation will be described with reference to FIGS. 3A and 3C.

Each of the first pulse output circuit 20_1 to the e-th pulse output circuit 20_*e* has terminals 21 to 27. The terminals 21 to 24 and the terminal 26 are input terminals; the terminals 25 and 27 are output terminals.

First, the terminal 21 will be described. The terminal 21 of the first pulse output circuit 20_1 is electrically connected to a wiring for supplying the start signal (GSP) for the scan line driver circuit. The terminals 21 of the second to e-th pulse output circuits 20_2 to 20_*e* are electrically connected to respective terminals 27 of their respective previous-stage pulse output circuits.

Next, the terminal 22 will be described. The terminal 22 of the (e+f+4−4a)-th pulse output circuit (a is a natural number less than or equal to e/4) is electrically connected to the wiring for supplying the first clock signal (GCK1) for the scan line driver circuit. The terminal 22 of the (e+f+3−4a)-th pulse output circuit is electrically connected to the wiring for supplying the second clock signal (GCK2) for the scan line driver circuit. The terminal 22 of the (e+f+2−4a)-th pulse output circuit is electrically connected to the wiring for supplying the third clock signal (GCK3) for the scan line driver circuit. The terminal 22 of the (e+f+1−4a)-th pulse output circuit is electrically connected to the wiring for supplying the fourth clock signal (GCK4) for the scan line driver circuit.

Then, the terminal 23 will be described. The terminal 23 of the (e+f+4−4a)-th pulse output circuit is electrically connected to the wiring for supplying the second clock signal (GCK2) for the scan line driver circuit. The terminal 23 of the (e+f+3-4a)-th pulse output circuit is electrically connected to the wiring for supplying the third clock signal (GCK3) for the scan line driver circuit. The terminal 23 of the (e+f+2-4a)-th pulse output circuit is electrically connected to the wiring for supplying the fourth clock signal (GCK4) for the scan line driver circuit. The terminal 23 of the (e+f+1−4a)-th pulse output circuit is electrically connected to the wiring for supplying the first clock signal (GCK1) for the scan line driver circuit.

Next, the terminal 24 will be described. The terminal 24 of the (2b−1)-th pulse output circuit (b is a natural number less than or equal to k/2) is electrically connected to the wiring for supplying the first pulse-width control signal (PWC1). The terminal 24 of the 2b-th pulse output circuit is electrically connected to the wiring for supplying the fourth pulse-width control signal (PWC4). The terminal 24 of the (2c−1)-th pulse output circuit (c is a natural number greater than or equal to (k/2+1) and less than or equal to k) is electrically connected to the wiring for supplying the second pulse-width control signal (PWC2). The terminal 24 of the 2c-th pulse output circuit is electrically connected to the wiring for supplying the fifth pulse-width control signal (PWC5). The terminal 24 of the (2d−1)-th pulse output circuit (d is a natural number greater than or equal to (k+1) and less than or equal to e/2) is electrically connected to the wiring for supplying the third pulse-width control signal (PWC3). The terminal 24 of the 2d-th pulse output circuit is electrically connected to the wiring for supplying the sixth pulse-width control signal (PWC6).

Then, the terminal 25 will be described. The terminal 25 of the x-th pulse output circuit (x is a natural number less than or equal to e) is electrically connected to the scan line 13_*x* in the x-th row.

Next, the terminal 26 will be described. The terminal 26 of the y-th pulse output circuit (y is a natural number less than or equal to e−1) is electrically connected to the terminal 27 of the (y+1)-th pulse output circuit. The terminal 26 of the e-th pulse output circuit is electrically connected to a wiring for supplying a stop signal (STP) for the e-th pulse output circuit. In the case where a (e+1)-th pulse output circuit is provided, the stop signal (STP) for the e-th pulse output circuit corresponds to a signal output from the terminal 27 of the (e+1)-th pulse output circuit. Specifically, the stop signal (STP) for the e-th pulse output circuit can be supplied to the e-th pulse output circuit by the (e+1)-th pulse output circuit provided as a dummy circuit or by inputting the signal directly from the outside.

Connection relation of the terminal 27 of each pulse output circuit is described above. Therefore, the above description is to be referred to.

<Structure Example of Scan Line Driver Circuit 11*f*>

Figure 4A:
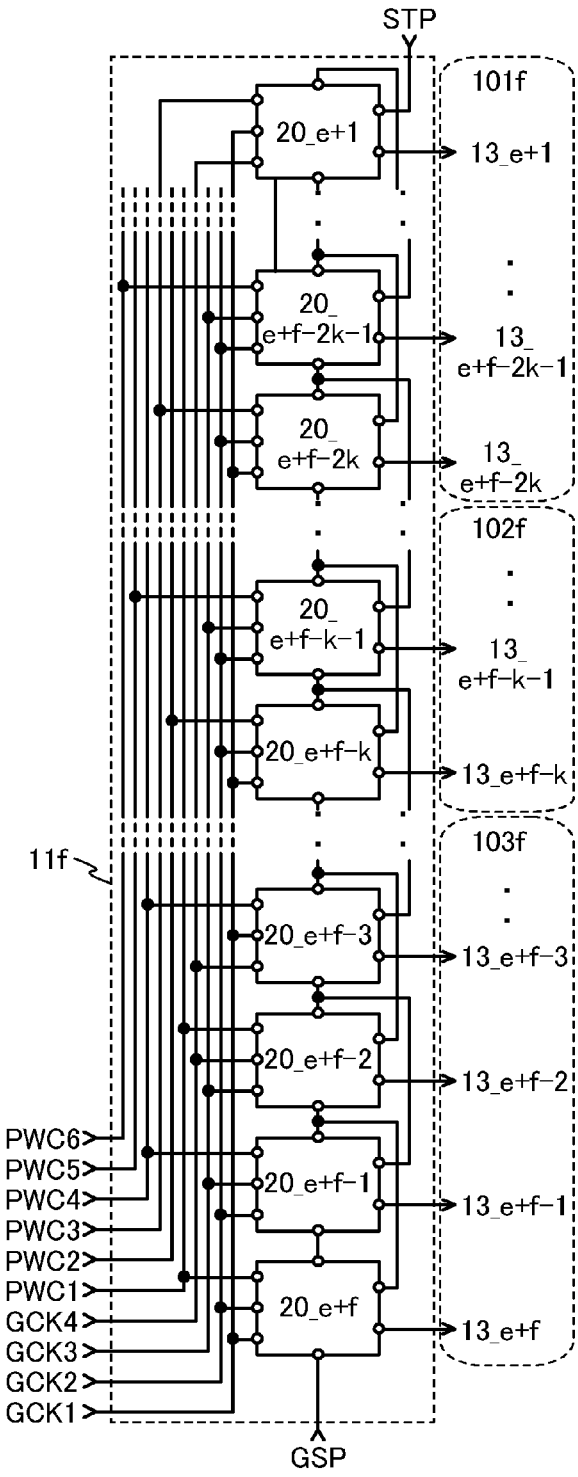
FIG. 4A illustrates a structure example of a scan line driver circuit.

FIG. 4A illustrates a structure example of the scan line driver circuit 11*f* included in the liquid crystal display device in FIG. 1. The scan line driver circuit 11*f* illustrated in FIG. 4A is provided with a structure in which the scan line driver circuit 11*e* illustrated in FIG. 3A is inverted in such a way that a selection signal is output to the pixels sequentially through the scan line 13_(*e*+*f*) in the (e+f)-th row to the scan line 13_(*e*+1) in the (e+1)-th row.

The scan line driver circuit 11*f* illustrated in FIG. 4A includes: respective wirings for supplying first to fourth clock signals (GCK1 to GCK4) for the scan line driver circuit; respective wirings for supplying first to sixth pulse-width control signals (PWC1 to PWC6); and the first pulse output circuit 20_*e*+1 which is electrically connected to the scan line 13 in the (e+1)-th row to the (e+f)-th pulse output circuit 20_(*e*+*f*) which is electrically connected to the scan line 13 in the (e+f)-th row. Note that here, the (e+1)-th pulse output circuit 20_(*e*+1) to the (e+f−2k)-th pulse output circuit 20_(*e*+*f*−2k) (k is less than f/2 and a multiple of 4) are electrically connected to the scan lines 13 provided for a region 101*f*; the (e+f−2k+1)-th pulse output circuit 20_(*e*+*f*−2k+1) to the (e+f−k)-th pulse output circuit 20_(*e*+*f*−*k*) are electrically connected to the scan lines 13 provided for a region 102*f*; and the (e+f−k+1)-th pulse output circuit 20_(*e*+*f*−*k*+1) to the (e+f)-th pulse output circuit 20_(*e*+*f*) are electrically connected to the scan lines 13 provided for a region 103*f*. In addition, the (e+1)-th pulse output circuit 20_(*e*+1) to the (e+f)-th pulse output circuit 20_(*e*+*f*) are configured to shift a shift pulse sequentially per shift period in response to a start pulse (GSP) for the scan line driver circuit which is input to the (e+f)-th pulse output circuit 20_(*e*+*f*). A plurality of shift pulses can be shifted in parallel in the (e+1)-th pulse output circuit 20_(*e*+1) to the (e+f)-th pulse output circuit 20_(*e*+*f*). In other words, even in a period in which a shift pulse is shifted in the (e+1)-th pulse output circuit 20_(*e*+1) to the (e+f)-th pulse output circuit 20_(*e*+*f*), the start pulse (GSP) for the scan line driver circuit can be input to the (e+f)-th pulse output circuit 20_(*e*+*f*).

Figure 4B:
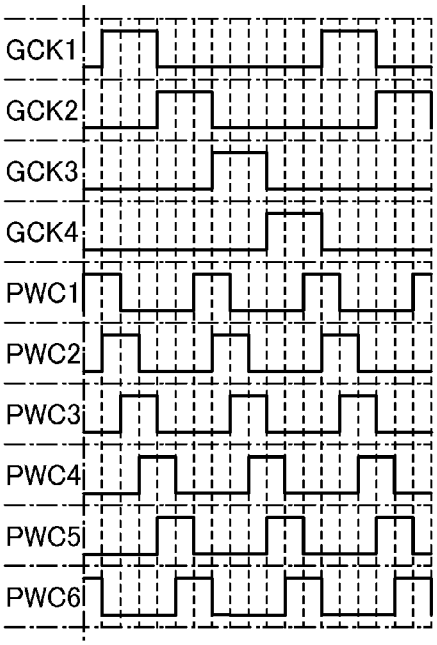
FIG. 4B is a timing diagram illustrating an example of a signal used for the scan line driver circuit.
Figure 4C:
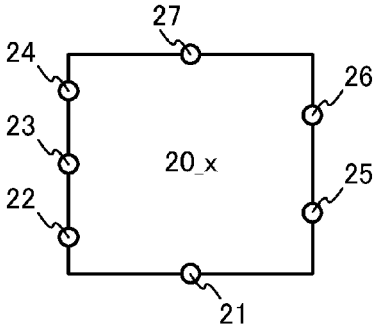
FIG. 4C illustrates a structure example of a pulse output circuit.

FIG. 4B illustrates examples of specific waveforms of the above-described signals. The first clock signal (GCK1) for the scan line driver circuit in FIG. 4B periodically repeats a high-level potential (high power supply potential (Vdd)) and a low-level potential (low power supply potential (Vss)), and has a duty ratio of 1/4. The second clock signal (GCK2) for the scan line driver circuit is a signal whose phase is deviated by 1/4 period from the first clock signal (GCK1) for the scan line driver circuit; the third clock signal (GCK3) for the scan line driver circuit is a signal whose phase is deviated by 1/2 period from the first clock signal (GCK1) for the scan line driver circuit; and the fourth clock signal (GCK4) for the scan line driver circuit is a signal whose phase is deviated by 3/4 period from the first clock signal (GCK1) for the scan line driver circuit. The first pulse-width control signal (PWC1) periodically repeats the high-level potential (high power supply potential (Vdd)) and the low-level potential (low power supply potential (Vss)), and has a duty ratio of 1/3. The second pulse-width control signal (PWC2) is a signal whose phase is deviated by 1/6 period from the first pulse-width control signal (PWC1); the third pulse-width control signal (PWC3) is a signal whose phase is deviated by 1/3 period from the first pulse-width control signal (PWC1); the fourth pulse-width control signal (PWC4) is a signal whose phase is deviated by 1/2 period from the first pulse-width control signal (PWC1); the fifth pulse-width control signal (PWC5) is a signal whose phase is deviated by 2/3 period from the first pulse-width control signal (PWC1); and the sixth pulse-width control signal (PWC6) is a signal whose phase is deviated by 5/6 period from the first pulse-width control signal (PWC1). Note that here, the ratio of the pulse width of each of the first to fourth clock signals (GCK1 to GCK4) for the scan line driver circuit, to the pulse width of each of the first to sixth pulse-width control signals (PWC1 to PWC6) is 3:2.

In the above-described liquid crystal display device, the same configuration can be applied to the (e+1)-th pulse output circuit 20_(*e*+1) to the (e+f)-th pulse output circuit 20_(*e*+*f*). Note that electrical connections of a plurality of terminals included in the pulse output circuit differ depending on the pulse output circuits. Specific connection relation will be described with reference to FIGS. 4A and 4C.

Each of the (e+1)-th pulse output circuit 20_(*e*+1) to the (e+f)-th pulse output circuit 20_(*e*+*f*) has the terminals 21 to 27. The terminals 21 to 24 and the terminal 26 are input terminals; the terminals 25 and 27 are output terminals.

First, the terminal 21 will be described. The terminal 21 of the (e+f)-th pulse output circuit 20_(*e*+*f*) is electrically connected to a wiring for supplying the start signal (GSP) for the scan line driver circuit. Respective terminals 21 of the (e+1)-th to (e+f−1)-th pulse output circuits 20_(*e*+1) to 20_(*e*+*f*−1) are electrically connected to respective terminals 27 of their respective previous-stage pulse output circuits. Note that the "previous-stage pulse output circuit" means a pulse output circuit which operates just before the present pulse output circuit, and the term is not directly associated with a placed position of the previous-stage pulse output circuit.

Next, the terminal 22 will be described. The terminal 22 of the (e+f+4−4a)-th pulse output circuit (a is a natural number less than or equal to e/4) is electrically connected to the wiring for supplying the first clock signal (GCK1) for the scan line driver circuit. The terminal 22 of the (e+f+3−4a)-th pulse output circuit is electrically connected to the wiring for supplying the second clock signal (GCK2) for the scan line driver circuit. The terminal 22 of the (e+f+2−4a)-th pulse output circuit is electrically connected to the wiring for supplying the third clock signal (GCK3) for the scan line driver circuit. The terminal 22 of the (e+f+1−4a)-th pulse output circuit is electrically connected to the wiring for supplying the fourth clock signal (GCK4) for the scan line driver circuit.

Then, the terminal 23 will be described. The terminal 23 of the (e+f+4−4a)-th pulse output circuit is electrically connected to the wiring for supplying the second clock signal (GCK2) for the scan line driver circuit. The terminal 23 of the (e+f+3−4a)-th pulse output circuit is electrically connected to the wiring for supplying the third clock signal (GCK3) for the scan line driver circuit. The terminal 23 of the (e+f+2−4a)-th pulse output circuit is electrically connected to the wiring for supplying the fourth clock signal (GCK4) for the scan line driver circuit. The terminal 23 of the (e+f+1−4a)-th pulse output circuit is electrically connected to the wiring for supplying the first clock signal (GCK1) for the scan line driver circuit.

Next, the terminal 24 will be described. The terminal 24 of the (2b−1)-th pulse output circuit (b is a natural number less than or equal to k/2) is electrically connected to the wiring for supplying the first pulse-width control signal (PWC1). The terminal 24 of the 2b-th pulse output circuit is electrically connected to the wiring for supplying the fourth pulse-width control signal (PWC4). The terminal 24 of the (2c−1)-th pulse output circuit (c is a natural number greater than or equal to (k/2+1) and less than or equal to k) is electrically connected to the wiring for supplying the second pulse-width control signal (PWC2). The terminal 24 of the 2c-th pulse output circuit is electrically connected to the wiring for supplying the fifth pulse-width control signal (PWC5). The terminal 24 of the (2d−1)-th pulse output circuit (d is a natural number greater than or equal to (k+1) and less than or equal to e/2) is electrically connected to the wiring for supplying the third pulse-width control signal (PWC3). The terminal 24 of the 2d-th pulse output circuit is electrically connected to the wiring for supplying the sixth pulse-width control signal (PWC6).

Then, the terminal 25 will be described. The terminal 25 of the x-th pulse output circuit (x is a natural number greater than or equal to (e+1) and less than or equal to (e+f)) is electrically connected to the scan line 13_*x* in the x-th row.

Next, the terminal 26 will be described. The terminal 26 of the y-th pulse output circuit (y is a natural number less than or equal to (e−1)) is electrically connected to the terminal 27 of the (y−1)-th pulse output circuit. The terminal 26 of the (e+1)-th pulse output circuit is electrically connected to a wiring for supplying a stop signal (STP) for the (e+1)-th pulse output circuit. Note that the stop signal (STP) for the (e+1)-th pulse output circuit can be supplied to the (e+1)-th pulse output circuit by providing, as a dummy circuit, the e-th pulse output circuit which is different from the pulse output circuit 20_*e* included in the scan line driver circuit 11*e* in the scan line driver circuit 11*f* or by inputting the signal directly from the outside.

Connection relation of the terminal 27 of each pulse output circuit is described above. Therefore, the above description is to be referred to.

<Structure Example of Pulse Output Circuit>

Figure 5A:
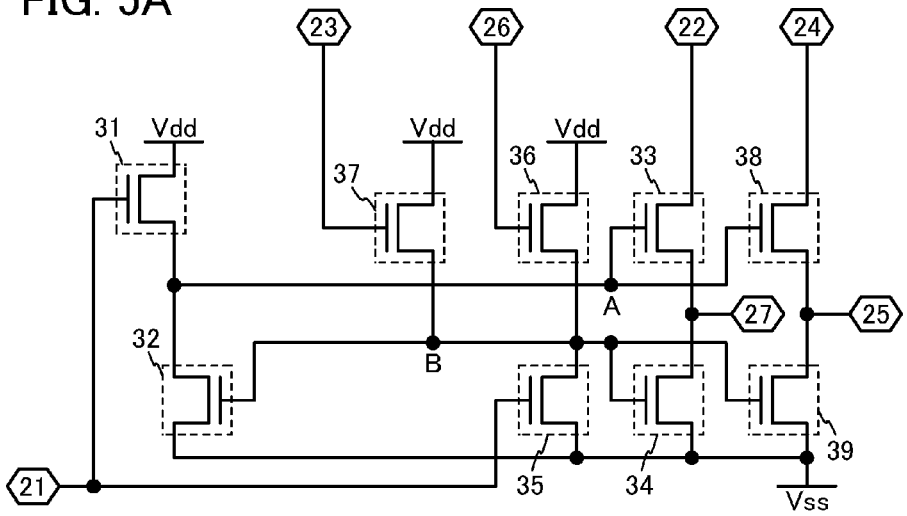
FIG. 5A is a circuit diagram illustrating an example of a pulse output circuit.

FIG. 5A illustrates a structure example of the pulse output circuit illustrated in FIGS. 3A and 3C and FIGS. 4A and 4C. A pulse output circuit illustrated in FIG. 5A includes transistors 31 to 39.

One of a source and a drain of the transistor 31 is electrically connected to a wiring for supplying the high power supply potential (Vdd) (hereinafter also referred to as a high power supply potential line). A gate of the transistor 31 is electrically connected to the terminal 21.

One of a source and a drain of the transistor 32 is electrically connected to a wiring for supplying the low power supply potential (Vss) (hereinafter also referred to as a low power supply potential line). The other of the source and the drain of the transistor 32 is electrically connected to the other of the source and the drain of the transistor 31.

One of a source and a drain of the transistor 33 is electrically connected to the terminal 22. The other of the source and the drain of the transistor 33 is electrically connected to the terminal 27. A gate of the transistor 33 is electrically connected to the other of the source and the drain of the transistor 31 and the other of the source and the drain of the transistor 32.

One of a source and a drain of the transistor 34 is electrically connected to the low power supply potential line. The other of the source and the drain of the transistor 34 is electrically connected to the terminal 27. A gate of the transistor 34 is electrically connected to a gate of the transistor 32.

One of a source and a drain of the transistor 35 is electrically connected to the low power supply potential line. The other of the source and the drain of the transistor 35 is electrically connected to the gate of the transistor 32 and the gate of the transistor 34. A gate of the transistor 35 is electrically connected to the terminal 21.

One of a source and a drain of the transistor 36 is electrically connected to the high power supply potential line. The other of the source and the drain of the transistor 36 is electrically connected to the gate of the transistor 32, the gate of the transistor 34, and the other of the source and the drain of the transistor 35. A gate of the transistor 36 is electrically connected to the terminal 26. Note that it is possible to employ a structure in which one of the source and the drain of the transistor 36 is electrically connected to a wiring for supplying a power supply potential (Vcc) which is higher than the low power supply potential (Vss) and lower than the high power supply potential (Vdd).

One of a source and a drain of the transistor 37 is electrically connected to the high power supply potential line. The other of the source and the drain of the transistor 37 is electrically connected to the gate of the transistor 32, the gate of the transistor 34, the other of the source and the drain of the transistor 35, and the other of the source and the drain of the transistor 36. A gate of the transistor 37 is electrically connected to the terminal 23. Note that it is possible to employ a structure in which one of the source and the drain of the transistor 37 is electrically connected to a wiring for supplying the power supply potential (Vcc).

One of a source and a drain of the transistor 38 is electrically connected to the terminal 24. The other of the source and the drain of the transistor 38 is electrically connected to the terminal 25. A gate of the transistor 38 is electrically connected to the other of the source and the drain of the transistor 31, the other of the source and the drain of the transistor 32, and the gate of the transistor 33.

One of a source and a drain of the transistor 39 is electrically connected to the low power supply potential line. The other of the source and the drain of the transistor 39 is electrically connected to the terminal 25. A gate of the transistor 39 is electrically connected to the gate of the transistor 32, the gate of the transistor 34, the other of the source and the drain of the transistor 35, the other of the source and the drain of the transistor 36, and the other of the source and the drain of the transistor 37.

In the following description, a node where the other of the source and the drain of the transistor 31, the other of the source and the drain of the transistor 32, the gate of the transistor 33, and the gate of the transistor 38 are electrically connected to each other is referred to as a node A; a node where the gate of the transistor 32, the gate of the transistor 34, the other of the source and the drain of the transistor 35, the other of the source and the drain of the transistor 36, the other of the source and the drain of the transistor 37, and the gate of the transistor 39 are electrically connected to each other is referred to as a node B.

<Operation Example of Pulse Output Circuit>

An operation example of the above-described pulse output circuit will be described with reference to FIGS. 5B to 5D, FIGS. 6A to 6C, and FIGS. 7A to 7C. Specifically, described here is an operation example in the case where a start pulse for the scan line driver circuit (GSP) is input to the terminal 21 of the first pulse output circuit 20_1 of the scan line driver circuit 11*e*, the terminal 21 of the first pulse output circuit 20_(*e*+*f*) of the scan line driver circuit 11*f*, and the terminal 21 of the first pulse output circuit 20_(*e*+*f*+1) of the scan line driver circuit 11*g* by controlling the timing. Timing of inputting the start pulse (GSP) is controlled, whereby shift pulses can be output from the terminals 27 of the first pulse output circuit 20_1, the (k+1)-th pulse output circuit 20_(*k*+1), and the (2k+1)-th pulse output circuit 20_(2k+1) at the same timing; shift pulses can be output from the terminals 27 of the (e+f)-th pulse output circuit 20_(*e*+*f*), the (e+f−k)-th pulse output circuit 20_(*e*+*f*−*k*), and the (e+f−2k)-th pulse output circuit 20_(*e*+*f*−2k) at the same timing; and shift pulses can be output from the terminals 27 of the (e+f+1)-th pulse output circuit 20_(*e*+*f*+1), the (e+f+k+1)-th pulse output circuit 20_(*e*+*f*+*k*+1), and the (e+f+2k+1)-th pulse output circuit 20_(*e*+*f*+2k+1) at the same timing.

The operation of the scan line driver circuit 11*e* is described. Specifically, the potentials of the signals which are input to the terminals of the first pulse output circuit 20_1 and the potentials of the node A and the node B when the start pulse (GSP) for the scan line driver circuit is input are illustrated in FIG. 5B; the potentials of the signals which are input to the terminals of the (k+1)-th pulse output circuit 20_(*k*+1) and the potentials of the node A and the node B when the high-level potential is input from the k-th pulse output circuit 20__*k* are illustrated in FIG. 5C; and the potentials of the signals which are input to the terminals of the (2k+1)-th pulse output circuit 20_(2k+1) and the potentials of the node A and the node B when the high-level potential is input from the 2k-th pulse output circuit 20__2k are illustrated in FIG. 5D.

Figure 5B:
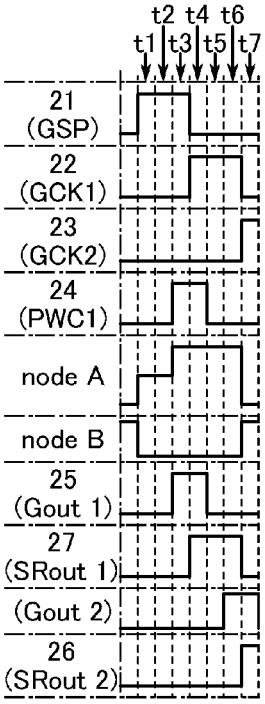
FIGS. 5B to 5D are timing diagrams each illustrating an example of operation of a pulse output circuit.
Figure 5C:
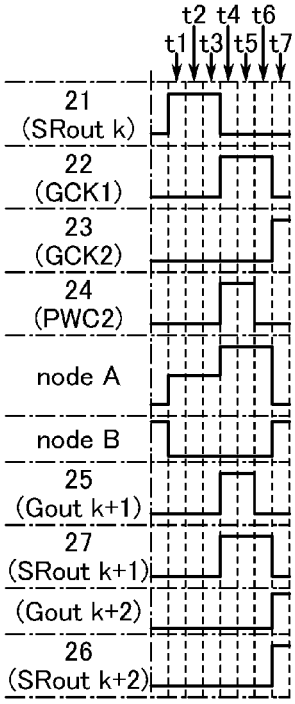
Figure 5D:
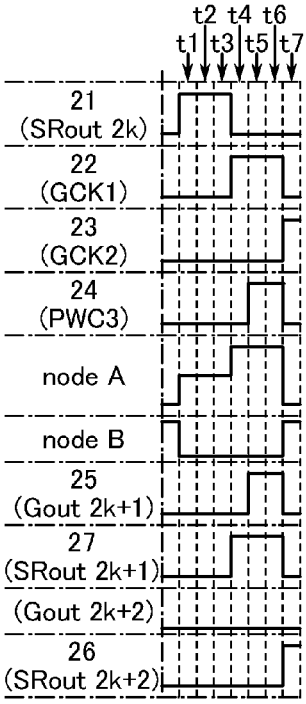

In FIGS. 5B to 5D, the signals which are input to the terminals are each provided in parentheses. In addition, the signal (Gout 2, Gout k+2, Gout 2k+2) which is output from the terminal 25 of the subsequent-stage pulse output circuit (the second pulse output circuit 20_2, the (k+2)-th pulse output circuit 20_(*k*+2), the (2k+2)-th pulse output circuit 20_(2k+2)), and the output signal of the terminal 27 of the subsequent-stage pulse output circuit (SRout 2: input signal of the terminal 26 of the first pulse output circuit 20_1, SRout k+2: input signal of the terminal 26 of the (k+1)-th pulse output circuit 20_(*k*+1), SRout 2k+2: input signal of the terminal 26 of the (2k+1)-th pulse output circuit 20_(2k+1)) are also illustrated. Note that in FIGS. 5B to 5D, Gout represents an output signal from the pulse output circuit to the scan line, and SRout represents an output signal from the pulse output circuit to the subsequent-stage pulse output circuit.

First, the case where the high-level potential is input as the start pulse (GSP) for the scan line driver circuit to the first pulse output circuit 20_1 will be described with reference to FIG. 5B.

In a period t1, the high-level potential (high power supply potential (Vdd)) is input to the terminal 21. Thus, the transistors 31 and 35 are turned on. As a result, the potential of the node A is increased to the high-level potential (potential that is decreased from the high power supply potential (Vdd) by the threshold voltage of the transistor 31), and the potential of the node B is decreased to the low power supply potential (Vss), so that the transistors 33 and 38 are turned on and the transistors 32, 34, and 39 are turned off. Thus, in the period t1, a signal output from the terminal 27 is a signal input to the terminal 22, and a signal output from the terminal 25 is a signal input to the terminal 24. Here in the period t1, both the signal input to the terminal 22 and the signal input to the terminal 24 are the low-level potential (low power supply potential (Vss)). Accordingly, in the period t1, the first pulse output circuit 20_1 outputs the low-level potential (low power supply potential (Vss)) to the terminal 21 of the second pulse output circuit 20_2 and the scan line in the first row in the pixel portion.

In a period t2, the levels of the signals input to the terminals are the same as in the period t1. Therefore, the potentials of the signals output from the terminals 25 and 27 are also not changed; the low-level potentials (low power supply potentials (Vss)) are output.

In a period t3, the high-level potential (high power supply potential (Vdd)) is input to the terminal 24. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is turned off. At this time, the input of the high-level potential (high power supply potential (Vdd)) to the terminal 24 further increases the potential of the node A (the potential of the gate of the transistor 38) by capacitive coupling between the source and the gate of the transistor 38 (bootstrapping). Owing to the bootstrapping, the potential of the signal output from the terminal 25 is not decreased from the high-level potential (high power supply potential (Vdd)) input to the terminal 24. Accordingly, in the period t3, the first pulse output circuit 20_1 outputs the high-level potential (high power supply potential (Vdd)=a selection signal) to the scan line in the first row in the pixel portion.

In a period t4, the high-level potential (high power supply potential (Vdd)) is input to the terminal 22. As a result, since the potential of the node A has been increased by the bootstrapping, the potential of the signal output from the terminal 27 is not decreased from the high-level potential (high power supply potential (Vdd)) input to the terminal 22. Accordingly, in the period t4, the terminal 27 outputs the high-level potential (high power supply potential (Vdd)) which is input to the terminal 22. In other words, the first pulse output circuit 20_1 outputs the high-level potential (high power supply potential (Vdd)=a shift pulse) to the terminal 21 of the second pulse output circuit 20_2. In the period t4 also, the signal input to the terminal 24 maintains the high-level potential (high power supply potential (Vdd)), so that the signal output to the scan line in the first row in the pixel portion from the first pulse output circuit 20_1 remains at the high-level potential (high power supply potential (Vdd)=the selection signal). Further, the low-level potential (low power supply potential (Vss)) is input to the terminal 21 to turn off the transistor 35, which does not directly influence the output signal of the pulse output circuit in the period t4.

In a period t5, the low-level potential (low power supply potential (Vss)) is input to the terminal 24. In that period, the transistor 38 maintains the on state. Accordingly, in the period t5, the first pulse output circuit 20_1 outputs the low-level potential (low power supply potential (Vss)) to the scan line arranged in the first row in the pixel portion.

In a period t6, the levels of the signals input to the terminals are the same as in the period t5. Therefore, the potentials of the signals output from the terminals 25 and 27 are also not changed; the low-level potential (low power supply potentials (Vss)) is output from the terminal 25 and the high-level potential (high power supply potential (Vdd)=the shift pulse) is output from the terminal 27.

In a period t7, the high-level potential (high power supply potential (Vdd)) is input to the terminal 23. Thus, the transistor 37 is turned on. As a result, the potential of the node B is increased to the high-level potential (potential that is decreased from the high power supply potential (Vdd) by the threshold voltage of the transistor 37). In other words, the transistors 32, 34, and 39 are turned on. On the other hand, the potential of the node A is decreased to the low-level potential (low power supply potential (Vss)). In other words, the transistors 33 and 38 are turned off. Accordingly, in the period t7, both of the signals output from the terminals 25 and 27 are at the low power supply potentials (Vss). In other words, in the period t7, the first pulse output circuit 20_1 outputs the low power supply potential (Vss) to the terminal 21 of the second pulse output circuit 20_2 and the scan line arranged in the first row in the pixel portion.

Next, the case where the high-level potential is input as the shift pulse from the k-th pulse output circuit 20_*k* to the terminal 21 of the (k+1)-th pulse output circuit 20_(*k*+1) will be described with reference to FIG. 5C.

Operation of the (k+1)-th pulse output circuit 20_(*k*+1) is as of the first pulse output circuit 20_1 in the periods t1 and t2. Therefore, the above description is to be referred to.

In the period t3, the levels of the signals input to the terminals are the same as in the period t2. Therefore, the potentials of the signals output from the terminals 25 and 27 are also not changed; the low-level potentials (low power supply potentials (Vss)) are output.

In the period t4, the high-level potentials (high power supply potentials (Vdd)) are input to the terminals 22 and 24. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is off in the period t1. The input of the high-level potentials (high power supply potentials (Vdd)) to the terminals 22 and 24 further increases the potential of the node A (the potentials of the gates of the transistors 33 and 38) by capacitive coupling between the source and the gate of the transistor 33 and capacitive coupling between the source and the gate of the transistor 38 (bootstrapping). Owing to the bootstrapping, the potentials of the signals output from the terminals 25 and 27 are not decreased from the high-level potentials (high power supply potentials (Vdd)) input to the terminals 22 and 24, respectively. Accordingly, in the period t4, the (k+1)-th pulse output circuit 20_(*k*+1) outputs the high-level potentials (high power supply potentials (Vdd)=a selection signal and a shift pulse) to the scan line in the (k+1)-th row in the pixel portion and the terminal 21 of the (k+2)-th pulse output circuit 20_(*k*+2).

In the period t5, the levels of the signals input to the terminals are the same as in the period t4. Therefore, the potentials of the signals output from the terminals 25 and 27 are also not changed; the high-level potentials (high power supply potentials (Vdd)=the selection signal and the shift pulse) are output.

In the period t6, the low-level potential (low power supply potential (Vss)) is input to the terminal 24. In that period, the transistor 38 maintains the on state. Accordingly, in the period t6, the (k+1)-th pulse output circuit 20_(*k*+1) outputs the low-level potential (low power supply potential (Vss)) to the scan line arranged in the (k+1)-th row in the pixel portion.

In the period t7, the high-level potential (high power supply potential (Vdd)) is input to the terminal 23. Thus, the transistor 37 is turned on. As a result, the potential of the node B is increased to the high-level potential (potential that is decreased from the high power supply potential (Vdd) by the threshold voltage of the transistor 37). In other words, the transistors 32, 34, and 39 are turned on. On the other hand, the potential of the node A is decreased to the low-level potential (low power supply potential (Vss)). In other words, the transistors 33 and 38 are turned off. Accordingly, in the period t7, both of the signals output from the terminals 25 and 27 are at the low power supply potentials (Vss). In other words, in the period t7, the (k+1)-th pulse output circuit 20_(*k*+1) outputs the low power supply potential (Vss) to the terminal 21 of the (k+2)-th pulse output circuit 20_(*k*+2) and the scan line arranged in the (k+1)-th row in the pixel portion.

Next, the case where the high-level potential is input as the shift pulse from the 2k-th pulse output circuit 20__2k to the terminal 21 of the (2k+1)-th pulse output circuit 20_(2k+1) will be described below with reference to FIG. 5D.

Operation of the (2k+1)-th pulse output circuit 20_(2k+1) is as of the (k+1)-th pulse output circuit 20_(*k*+1) in the periods t1 to t3. Therefore, the above description is to be referred to.

In the period t4, the high-level potential (high power supply potential (Vdd)) is input to the terminal 22. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is turned off in the period t1. The input of the high-level potential (high power supply potential (Vdd)) to the terminal 22 further increases the potential of the node A (the potential of the gate of the transistor 33) by capacitive coupling between the source and the gate of the transistor 33 (bootstrapping). Owing to the bootstrapping, the potential of the signal output from the terminal 27 is not decreased from the high-level potential (high power supply potential (Vdd)) input to the terminal 22. Accordingly, in the period t4, the (2k+1)-th pulse output circuit 20_(2k+1) outputs the high-level potential (high power supply potential (Vdd)=a shift pulse) to the terminal 21 of the (2k+2)-th pulse output circuit 20_(2k+2). Further, the low-level potential (low power supply potential (Vss)) is input to the terminal 21 to turn off the transistor 35, which does not directly influence the output signal of the pulse output circuit in the period t4.

In the period t5, the high-level potential (high power supply potential (Vdd)) is input to the terminal 24. As a result, since the potential of the node A has been increased by the bootstrapping, the potential of the signal output from the terminal 25 is not decreased from the high-level potential (high power supply potential (Vdd)) input to the terminal 24. Accordingly, in the period t5, the terminal 25 outputs the high-level potential (high power supply potential (Vdd)) which is input to the terminal 22. In other words, the (2k+1)-th pulse output circuit 20_(2k+1) outputs the high-level potential (high power supply potential (Vdd)=a selection signal) to the scan line arranged in the (2k+1)-th row in the pixel. In the period t5 also, the signal input to the terminal 22 maintains the high-level potential (high power supply potential (Vdd)), so that the signal output from the (2k+1)-th pulse output circuit 20_(2k+1) to the terminal 21 of the (2k+2)-th pulse output circuit 20_(2k+2) remains at the high-level potential (high power supply potential (Vdd)=the shift pulse).

In the period t6, the levels of the signals input to the terminals are the same as in the period t5. Therefore, the potentials of the signals output from the terminals 25 and 27 are also not changed; the high-level potentials (high power supply potentials (Vdd)=the selection signal and the shift pulse) are output.

In the period t7, the high-level potential (high power supply potential (Vdd)) is input to the terminal 23. Thus, the transistor 37 is turned on. As a result, the potential of the node B is increased to the high-level potential (potential that is decreased from the high power supply potential (Vdd) by the threshold voltage of the transistor 37). In other words, the transistors 32, 34, and 39 are turned on. On the other hand, the potential of the node A is decreased to the low-level potential (low power supply potential (Vss)). In other words, the transistors 33 and 38 are turned off. Accordingly, in the period t7, both of the signals output from the terminals 25 and 27 are the low power supply potential (Vss). In other words, in the period t7, the (k+1)-th pulse output circuit 20_(*k*+1) outputs the low power supply potential (Vss) to the terminal 21 of the (k+2)-th pulse output circuit 20_(*k*+2) and the scan line arranged in the (k+1)-th row in the pixel portion.

As illustrated in FIGS. 5B to 5D, with the first pulse output circuit 20_1 to the m-th pulse output circuit 20_*m*, a plurality of shift pulses can be shifted in parallel by controlling the timing of inputting the start pulse (GSP) for the scan line driver circuit. Specifically, after the start pulse (GSP) for the scan line driver circuit is input, the start pulse (GSP) for the scan line driver circuit is input again at the timing at which the terminal 27 of the k-th pulse output circuit 20_*k* outputs a shift pulse, whereby shift pulses can be output from the first pulse output circuit 20_1 and the (k+1)-th pulse output circuit 20_(*k*+1) at the same timing. The start pulse (GSP) for the scan line driver circuit can be further input in a similar manner, whereby shift pulses can be output from the first pulse output circuit 20_1, the (k+1)-th pulse output circuit 20_(*k*+1), and the (2k+1)-th pulse output circuit 20_(2k+1) at the same timing.

In addition, the first pulse output circuit 20_1, the (k+1)-th pulse output circuit 20_(*k*+1), and the (2k+1)-th pulse output circuit 20_(2k+1) can supply selection signals to respective scan lines at different timings in parallel to the above-described operation. In other words, with the scan line driver circuit, a plurality of shift pulses including a specific shift period can be shifted, and a plurality of pulse output circuits to which shift pulses are input at the same timing can supply selection signals to their respective scan lines at different timings.

Figure 6A:
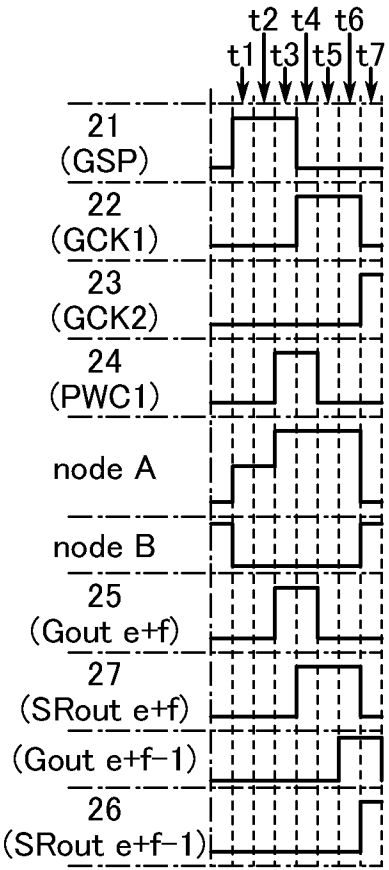
FIGS. 6A to 6C are timing diagrams each illustrating an example of operation of a pulse output circuit.
Figure 6B:
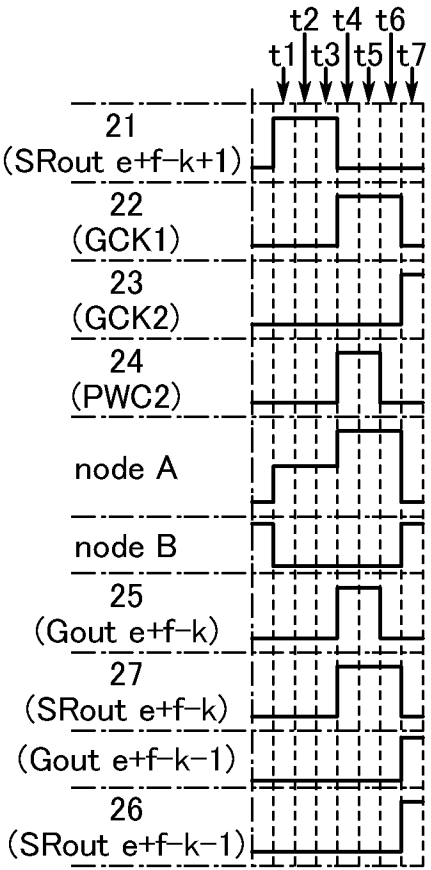
Figure 6C:
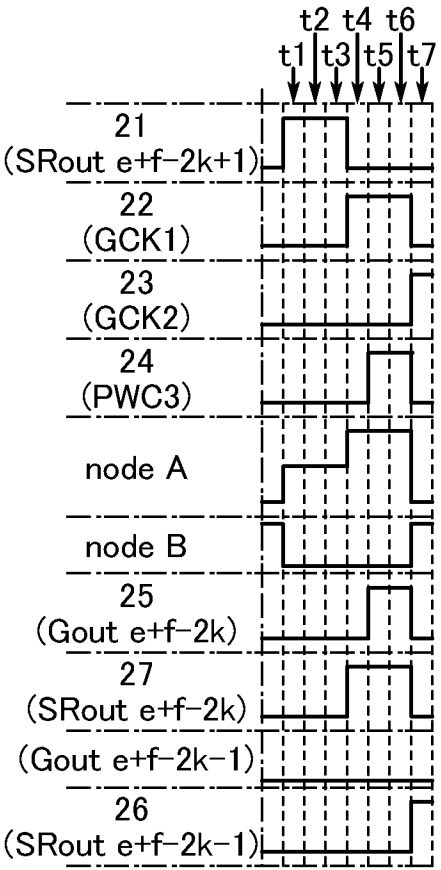

Next, the operation of the scan line driver circuit 11*f* will be described. Specifically, the potentials of the signals which are input to the terminals of the (e+f)-th pulse output circuit 20_(*e*+*f*) and the potentials of the node A and the node B when the start pulse (GSP) for the scan line driver circuit is input are illustrated in FIG. 6A; the potentials of the signals which are input to the terminals of the (e+f−k)-th pulse output circuit 20_(*e*+*f*−*k*) and the potentials of the node A and the node B when the high-level potential is input from the (e+f−k+1)-th pulse output circuit 20_(*e*+*f*−*k*+1) are illustrated in FIG. 6B; and the potentials of the signals which are input to the terminals of the (e+f−2k)-th pulse output circuit 20_(*e*+*f*−2k) and the potentials of the node A and the node B when the high-level potential is input from the (e+f−2k+1)-th pulse output circuit 20_(*e*+*f*−2k+1) are illustrated in FIG. 6C.

Note that the scan line driver circuit 11*f* has a structure in which the scan line driver circuit 11*e* is inverted in a row direction, and a shift is sequentially performed from the scan line 13_(*e*+*f*) in the (e+f)-th row to the scan line 13_(*e*+1) in the (e+1)-th row. Therefore, the operation of the x-th pulse output circuit 20_*x* (x is a natural number greater than or equal to (e+1) and less than or equal to (e+f)) connected to the scan line in the x-th row is the same as that of the (e+f+1−x)-th pulse output circuit 20_(*e*+*f*+1−x). Specifically, the operation of the (e+f)-th pulse output circuit 20_(*e*+*f*) is the same as that of the first pulse output circuit 20_1; the operation of the (e+f−k)-th pulse output circuit 20_(*e*+*f*−*k*) is the same as that of the (k+1)-th pulse output circuit 20_(*k*+1); and the operation of the (e+f−2k)-th pulse output circuit 20_(*e*+*f*−2k) is the same as that of the (2k+1)-th pulse output circuit 20_(2k+1). Therefore, as for the detailed operation of the x-th pulse output circuit 20_*x* of the scan line driver circuit 11*f*, the operation of the (e+f+1−x)-th pulse output circuit 20_(*e*+*f*+1−x) described in the description of the scan line driver circuit 11*e* can be rephrased as the operation of the x-th pulse output circuit 20_*x*.

Figure 7A:
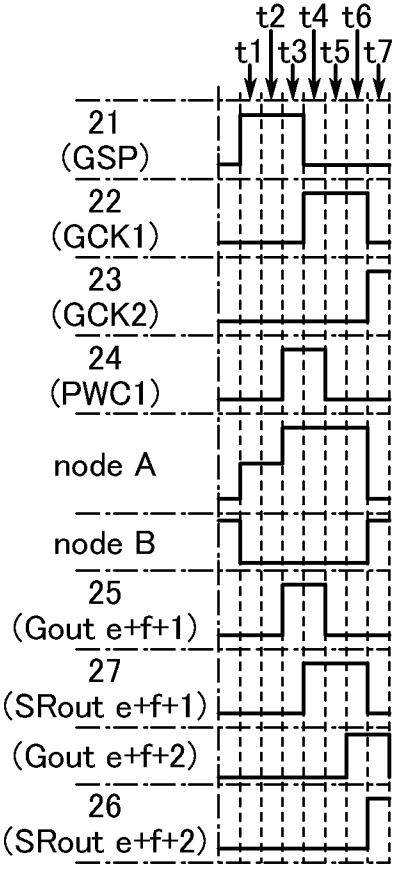
FIGS. 7A to 7C are timing diagrams each illustrating an example of operation of a pulse output circuit.
Figure 7B:
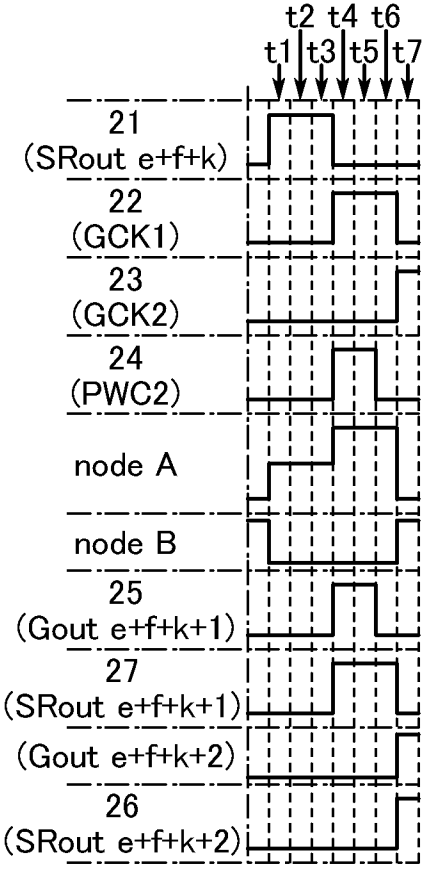
Figure 7C:
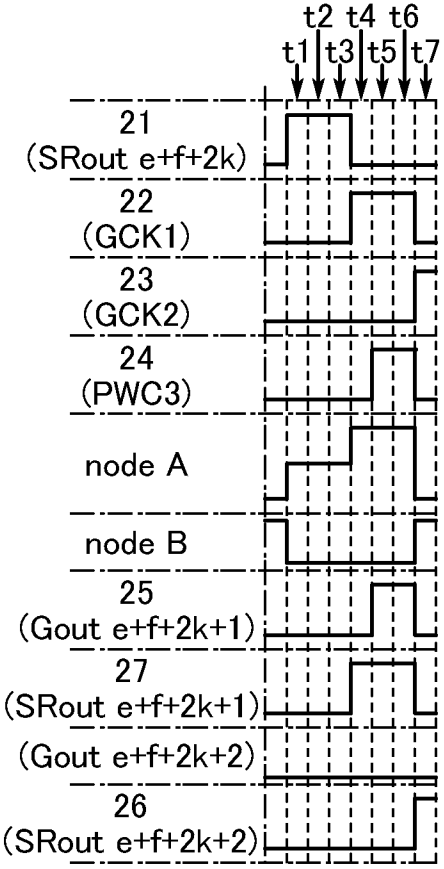

Next, the operation of the scan line driver circuit 11*g* will be described. Specifically, the potentials of the signals which are input to the terminals of the (e+f+1)-th pulse output circuit 20_(*e*+*f*+1) and the potentials of the node A and the node B when the start pulse (GSP) for the scan line driver circuit is input are illustrated in FIG. 7A; the potentials of the signals which are input to the terminals of the (e+f+k+1)-th pulse output circuit 20_(*e*+*f*+*k*+1) and the potentials of the node A and the node B when the high-level potential is input from the (e+f+k)-th pulse output circuit 20_(*e*+*f*+*k*) are illustrated in FIG. 7B; and the potentials of the signals which are input to the terminals of the (e+f+2k+1)-th pulse output circuit 20_(*e*+*f*+2k+1) and the potentials of the node A and the node B when the high-level potential is input from the (e+f+2k)-th pulse output circuit 20_(*e*+*f*+2k) are illustrated in FIG. 7C.

Note that the scan line driver circuit 11*g* has a structure which is the same as that of the scan line driver circuit 11*e*, and a shift is sequentially performed from the scan line 13_(*e*+*f*+1) in the (e+f+1)-th row to the scan line 13_*m* in the m-th row. Therefore, the operation of the x-th pulse output circuit 20_*x* (x is a natural number greater than or equal to (e+f+1) and less than or equal to m) connected to the scan line in the x-th row is the same as that of the (x−e−f)-th pulse output circuit 20_(*x*−*e*−*f*). Specifically, the operation of the (e+f+1)-th pulse output circuit 20_(*e*+*f*+1) is the same as that of the first pulse output circuit 20_1; the operation of the (e+f+k+1)-th pulse output circuit 20_(*e*+*f*+*k*+1) is the same as that of the (k+1)-th pulse output circuit 20_(*k*+1); and the operation of the (e+f+2k+1)-th pulse output circuit 20_(*e*+*f*+2k+1) is the same as that of the (2k+1)-th pulse output circuit 20_(2k+1). Therefore, as for the detailed operation of the x-th pulse output circuit 20_*x* of the scan line driver circuit 11*g*, the operation of the (x−e−f)-th pulse output circuit 20_(*x*−*e*−*f*) described in the description of the scan line driver circuit 11*e* can be rephrased as the operation of the x-th pulse output circuit 20_*x*.

<Structure Example of Signal Line Driver Circuit 12>

Figure 8:
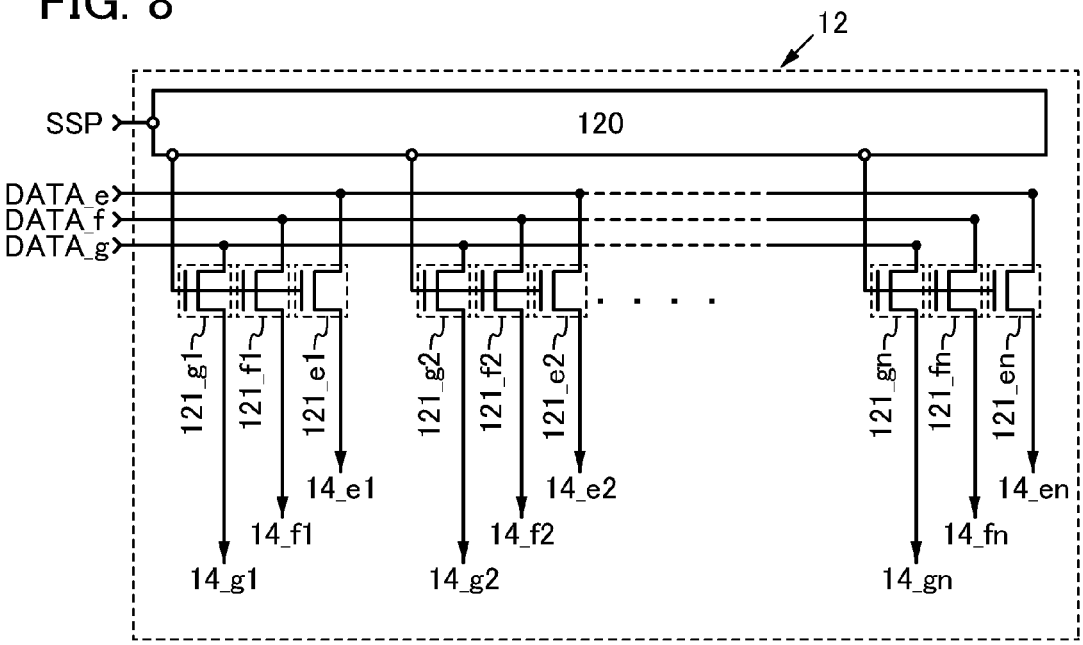
FIG. 8 illustrates a structure example of a signal line driver circuit.

FIG. 8 illustrates a structure example of the signal line driver circuit 12 included in the liquid crystal display device in FIG. 1. The signal line driver circuit 12 illustrated in FIG. 8 includes a shift register 120 having first to n-th output terminals, three wirings for supplying an image signal, and 3n transistors which connect any of the three wirings to the 3n signal lines 14 arranged in a pixel portion.

The pixel portion 10 is divided into three ranges, and three wirings in total supply an image signal. Note that an image signal DATA_e is displayed in the range 10*e*, an image signal DATA_f is displayed in the range 10*f*, and an image signal DATA_g is displayed in the range 10*g*.

One of a source and a drain of each of transistors 121_*e*1 to 121_*en* is electrically connected to the wiring for supplying the image signal DATA_e. The other of the source and the drain of the transistor 121_*e*1 is electrically connected to the signal line 14_*e*1 arranged in the first column in the pixel portion, and a gate of the transistor 121_*e*1 is electrically connected to the first output terminal of the shift register 120. The other of the source and the drain of the transistor 121_*en* is electrically connected to the signal line 14_*en* arranged in the n-th column in the pixel portion, and a gate of the transistor 121_*en* is electrically connected to the n-th output terminal of the shift register 120.

One of a source and a drain of each of transistors 121_*f*1 to 121_*fn* is electrically connected to the wiring for supplying the image signal DATA_f. The other of the source and the drain of the transistor 121_*f*1 is electrically connected to the signal line 14_*f*1 arranged in the first column in the pixel portion, and a gate of the transistor 121_*f*1 is electrically connected to the first output terminal of the shift register 120. The other of the source and the drain of the transistor 121_*fn* is electrically connected to the signal line 14_*fn* arranged in the n-th column in the pixel portion, and a gate of the transistor 121_*fn* is electrically connected to the n-th output terminal of the shift register 120.

One of a source and a drain of each of transistors 121_*g*1 to 121_*gn* is electrically connected to the wiring for supplying the image signal DATA_g. The other of the source and the drain of the transistor 121_*g*1 is electrically connected to the signal line 14_*g*1 arranged in the first column in the pixel portion, and a gate of the transistor 121_*g*1 is electrically connected to the first output terminal of the shift register 120. The other of the source and the drain of the transistor 121_*gn* is electrically connected to the signal line 14_*gn* arranged in the n-th column in the pixel portion, and a gate of the transistor 121_*gn* is electrically connected to the n-th output terminal of the shift register 120.

The shift register 120 has a function of outputting the high-level potential sequentially from the first to n-th output terminals per shift period in response to a start pulse for the signal line driver circuit (SSP). In other words, the wiring which supply image signals and the signal lines are sequentially connected to each other until the transistor 121_*e*2, the transistor 121_*f*2, and the transistor 121_*g*2 are in a shift-period-on-state at the same time, and the transistor 121_*en*, the transistor 121_*fn*, and the transistor 121_*gn* are in a shift-period-on-state at the same time after the transistor 121_*e*1, the transistor 121_*f*1, and the transistor 121_*g*1 which are connected to the first output terminal are in a shift-period-on-state at the same time.

Figure 9:
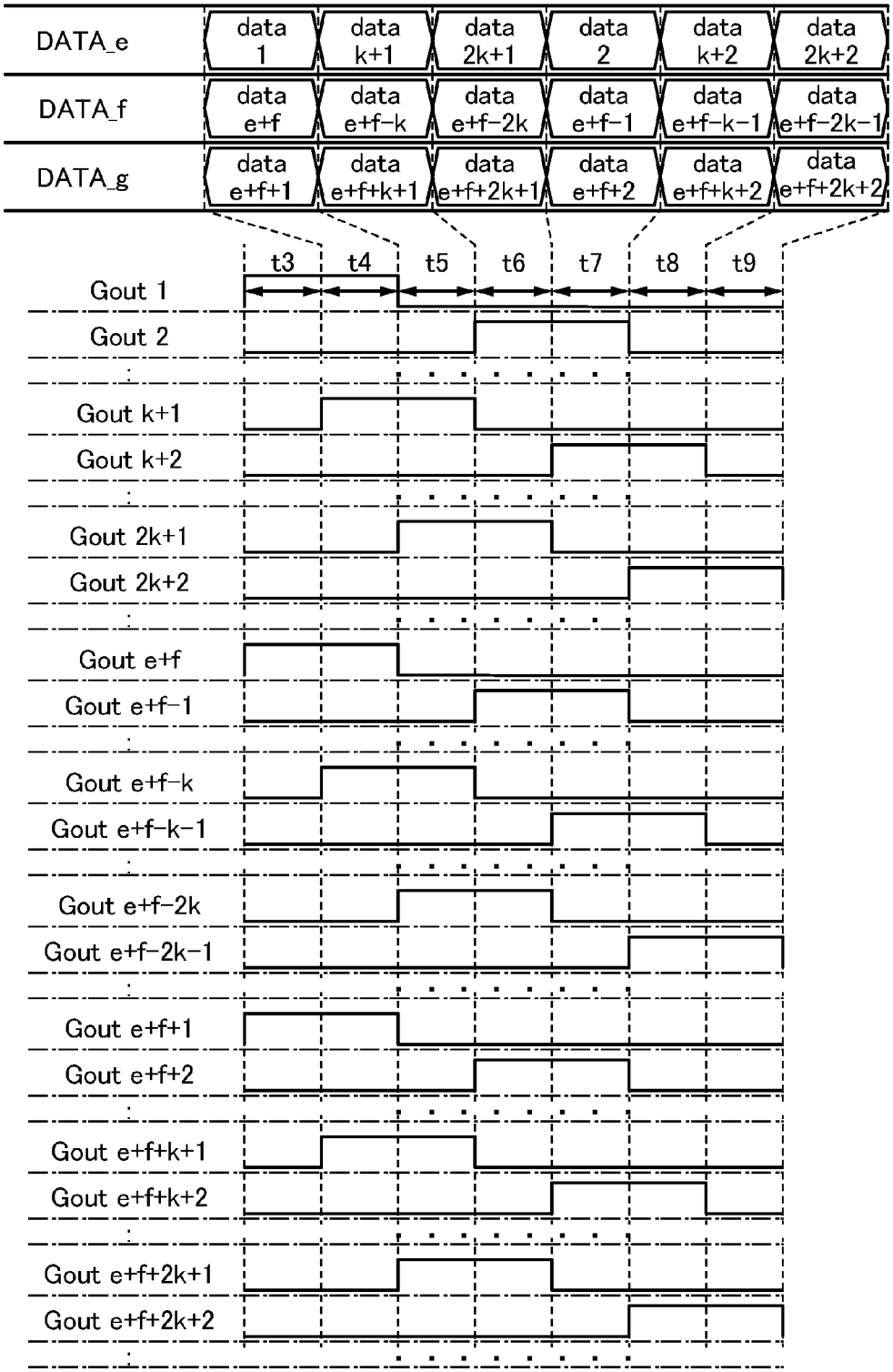
FIG. 9 is a timing diagram illustrating an example of operation of a signal line driver circuit.

FIG. 9 illustrates an example of timing of image signals which are supplied through the wirings for respectively supplying the image signal DATA_e, the image signal DATA_f, and the image signal DATA_g. As illustrated in FIG. 9, the wiring for supplying the image signal DATA_e supplies an image signal for a pixel arranged in the first row (data 1) in the period t4; an image signal for a pixel arranged in the (k+1)-th row (data k+1) in the period t5; an image signal for a pixel arranged in the (2k+1)-th row (data 2k+1) in the period t6; and an image signal for a pixel arranged in the second row (data 2) in the period t7. In this manner, the wiring for supplying the image signal (DATA) supplies image signals for pixels arranged in respective rows sequentially. Specifically, image signals are supplied in the following order: an image signal for a pixel arranged in the s-th row (s is a natural number less than k)→an image signal for a pixel arranged in the (k+s)-th row→an image signal for a pixel arranged in the (2k+s)-th row→an image signal for a pixel arranged in the (s+1)-th row.

The wiring for supplying the image signal DATA_f supplies an image signal for a pixel arranged in the (e+f)-th row (data e+f) in the period t4; an image signal for a pixel arranged in the (e+f−k)-th row (data e+f−k) in the period t5; an image signal for a pixel arranged in the (e+f−2k)-th row (data e+f−2k) in the period t6; and an image signal for a pixel arranged in the (e+f−1)-th row (data e+f−1) in the period t7. Similarly, the wiring for supplying the image signal DATA_f sequentially supplies an image signal for a pixel arranged in each given row. Specifically, image signals are supplied in the following order: an image signal for a pixel arranged in the s'-th row (s' is a natural number greater than or equal to k)→an image signal for a pixel arranged in the (s'−k)-th row→an image signal for a pixel arranged in the (s'−2k)-th row→an image signal for a pixel arranged in the (s'−1)-th row.

The wiring for supplying the image signal DATA_g supplies an image signal for a pixel arranged in the (e+f+1)-th row (data e+f+1) in the period t4; an image signal for a pixel arranged in the (e+f+k+1)-th row (data e+f+k+1) in the period t5; an image signal for a pixel arranged in the (e+f+2k+1)-th row (data e+f+2k+1) in the period t6; and an image signal for a pixel arranged in the (e+f+2)-th row (data e+f+2) in the period t7. Similarly, the wiring for supplying the image signal DATA_f sequentially supplies an image signal for a pixel arranged in each given row. Specifically, image signals are supplied in the following order: an image signal for a pixel arranged in the s-th row (s is a natural number less than k)→an image signal for a pixel arranged in the (k+s)-th row→an image signal for a pixel arranged in the (2k+s)-th row→an image signal for a pixel arranged in the (s+1)-th row.

When the above-described operation is performed by the scan line driver circuits 11*e* to 11*g* and the signal line driver circuit 12, the image signals can be input to the pixels in three rows arranged in the pixel portion per shift period of the pulse output circuit of each of the scan line driver circuits 11*e* to 11*g*.

<Structure Example of Backlight and Backlight Driver Circuit>

Figure 10:
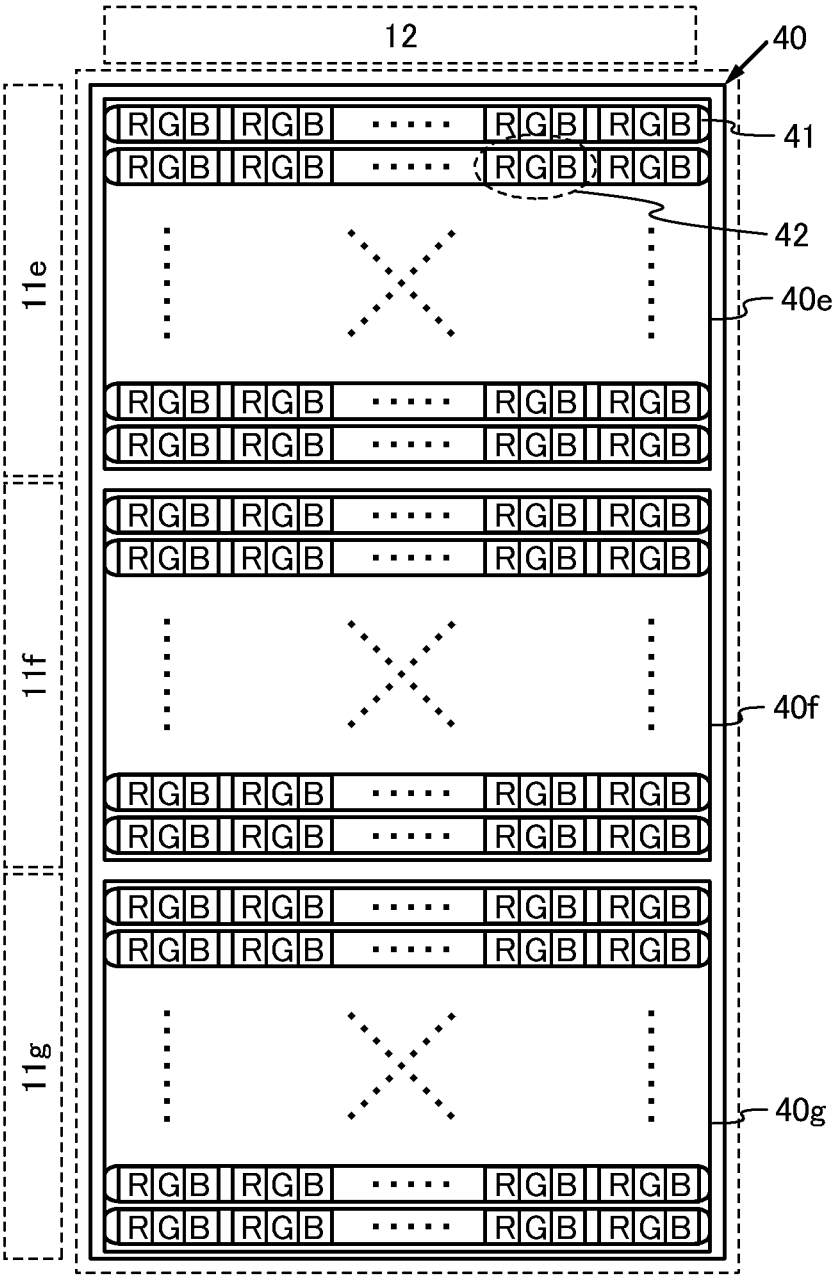
FIG. 10 illustrates a structure example of a backlight.

FIG. 10 illustrates a structure example of a backlight panel 40 provided behind the pixel portion 10 in the liquid crystal display device illustrated in FIG. 1. The backlight panel 40 illustrated in FIG. 10 includes a plurality of backlight arrays 41 arranged in the column direction, and each of the plurality of backlight arrays 41 includes a plurality of backlight units 42 each including a light source that emits red (R) light, a light source that emits green (G) light, and a light source that emits blue (B) light. Note that the plurality of backlight units 42 can control turning on of the light sources per given region, and any arrangement of the plurality of backlight units 42 is possible as long as light can be delivered to the region substantially uniformly; for example the plurality of backlight units 42 may be arranged in a matrix behind the pixel portion 10. In addition, the backlight panel 40 is divided into three ranges (ranges 40*e* to 40*g*). The range 40*e* overlaps with the range 10*e* of the pixel portion 10; the range 40*f* overlaps with the range 10*f* of the pixel portion 10; and the range 40*g* overlaps with the range 10*g* of the pixel portion 10.

Note that as a light source used for the backlight unit 42, a light-emitting element which has high luminous efficiency such as a light-emitting diode (LED) or an organic light-emitting diode (OLED) is preferably used.

Figure 11:
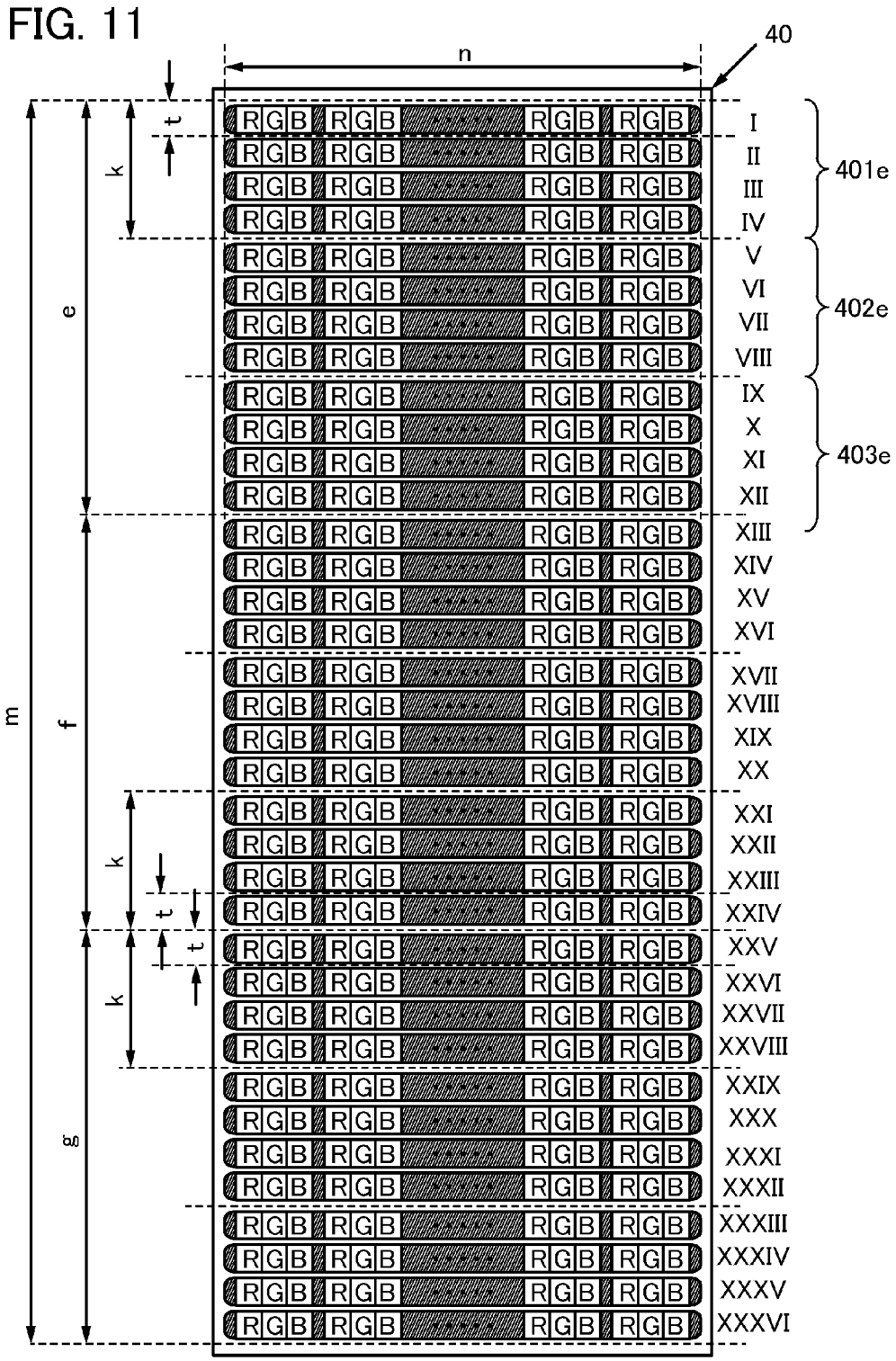
FIG. 11 illustrates a structure example of a backlight.

FIG. 11 illustrates an example of positional relation of the backlight panel 40 and the plurality of pixels 15 which is provided in front of the backlight panel 40 in m rows and n columns and is not illustrated. In the backlight panel, at least one backlight array which can be turned on independently is provided for each group of t rows (here t is k/4), and each backlight array is used for substantially uniform irradiation of the plurality of pixels 15 arranged in t rows and n columns.

Specifically, the backlight panel 40 includes at least a backlight array I for the first to t-th rows to a backlight array XXXVI for the (e+f+2k+3t+1)-th to m-th rows, and the backlight arrays can be turned on independently. Further, in each backlight array, the light sources that emit light of different colors (e.g., the light source that emits red (R) light, the light source that emits green (G) light, and the light source that emits blue (B) light) can be turned on independently. In other words, in any one of the backlight arrays, any one of the light source that emits red (R) light, the light source that emits green (G) light, and the light source that emits blue (B) light is turned on, whereby red (R) light, green (G) light, or blue (B) light can be delivered to a specific region of the pixel portion 10.

Note that it is possible to have a structure in which chromatic color light formed by a mixture of lights of two colors can be delivered to the pixel portion 10 by turning on of any two of the light source that emits red (R) light, the light source that emits green (G) light, and the light source that emits blue (B) light; and/or a structure in which white (W) light formed by a mixture of lights of three colors can be delivered to the pixel portion 10 by turning on of all of the light source that emits red (R) light, the light source that emits green (G) light, and the light source that emits blue (B) light.

Note that a unit which controls emission intensity can be selected as appropriate in accordance with the kind of the light sources used in the backlight unit 42.

<Operation Example of Liquid Crystal Display Device>

Figure 12:
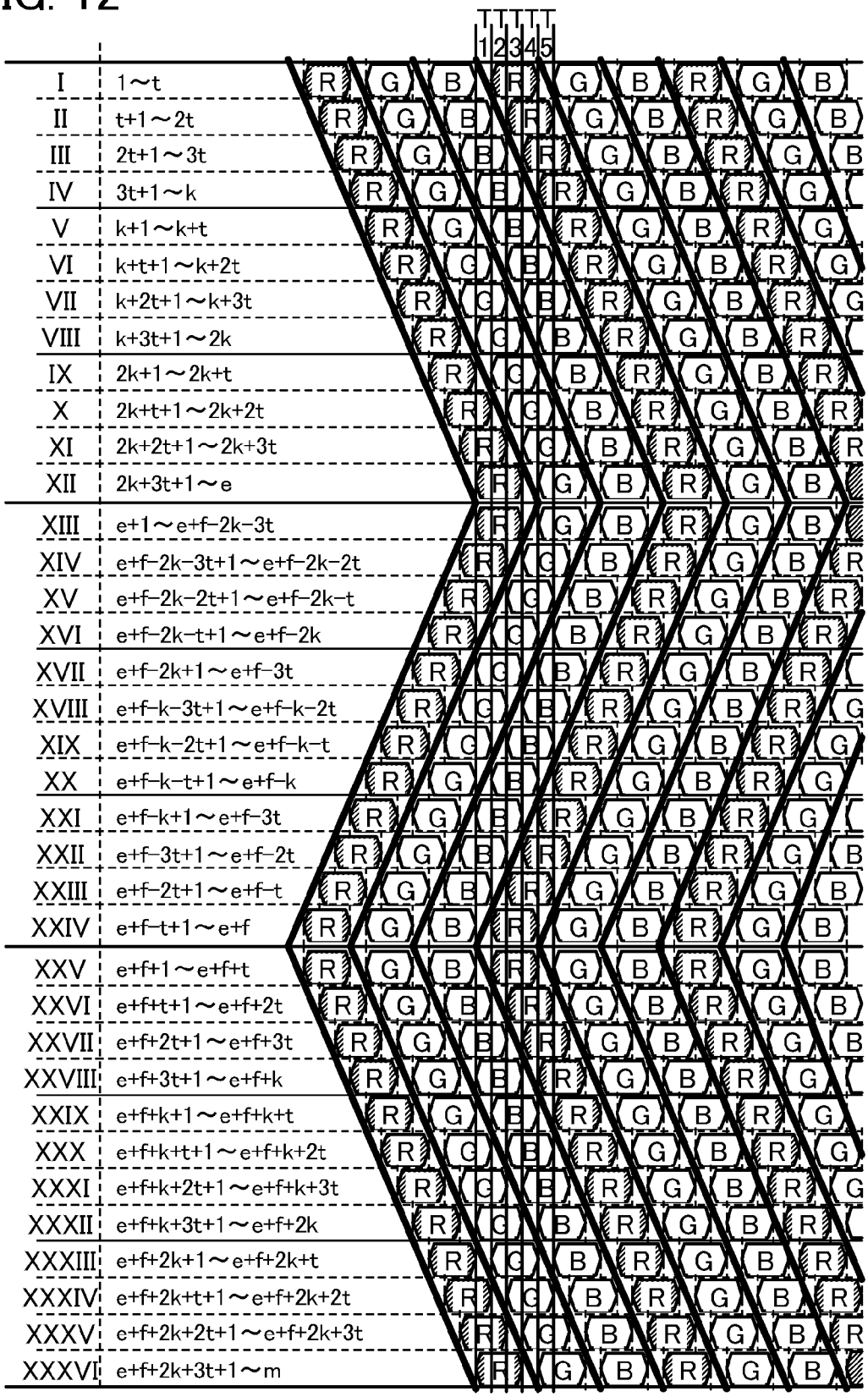
FIG. 12 illustrates an operation example of a liquid crystal display device.

FIG. 12 illustrates timing of scanning of a selection signal in the above-described liquid crystal display device and timing of turning on the backlight array I for the first to t-th rows to the backlight array XXXVI for the (e+f+2k+3t+1)-th to m-th rows included in the backlight. Note that the vertical axis represents rows (first to m-th rows) in the pixel portion, and the horizontal axis represents time in FIG. 12.

As illustrated in FIG. 12, as for the scan line arranged in the first row to the scan line arranged in the e-th row in the liquid crystal display device, selection signals are supplied to rows which are spaced by k rows, which is performed sequentially in ascending order by one row. Specifically, the selection signals are supplied in the following order: the scan line in the first row the scan line in the (k+1)-th row→the scan line in the (2k+1)-th row→the scan line in the second row→the scan line in the (k+2)-th row→the scan line in the (2k+2)-th row.

In addition, as for the scan line arranged in the (e+f)-th row to the scan line arranged in the (e+1)-th row, the selection signals are supplied to rows which are spaced by k rows, which is performed sequentially in descending order by one row. Specifically, the selection signals are supplied in the following order: the scan line in the (e+f)-th row→the scan line in the (e+f−k)-th row→the scan line in the (e+f−2k)-th row→the scan line in the (e+f−1)-th row→the scan line in the (e+f−k−1)-th row→the scan line in the (e+f−2k−1)-th row.

Further, as for the scan lines arranged in the (e+g+1)-th to the m-th rows, selection signals are supplied to rows which are spaced by k rows, which is performed sequentially in ascending order by one row. Specifically, the selection signals are supplied in the following order: the scan line in the (e+g+1)-th row→the scan line in the (e+g+k+1)-th row→the scan line in the (e+g+2k+1)-th row→the scan line in the (e+g+2)-th row→the scan line in the (e+g+k+2)-th row→the scan line in the (e+g+2k+2)-th row.

When the selection signals are supplied in the above-described order, in a period (T1) as illustrated in FIG. 12 for example, n pixels arranged in the first row to n pixels arranged in the t-th row, n pixels arranged in the (e+f)-th row to n pixels arranged in the (e+f−t+1)-th row, and n pixels arranged in the (e+f+1)-th row to n pixels arranged in the (e+f+t)-th row can be sequentially selected, and an image signal for controlling transmission of red (R) light can be input; n pixels arranged in the (k+1)-th row to n pixels arranged in the (k+t)-th row, n pixels arranged in the (e+f−k)-th row to n pixels arranged in the (e+f−k−t+1)-th row, and n pixels arranged in the (e+f+k+1)-th row to n pixels arranged in the (e+f+k+t)-th row can be sequentially selected, and an image signal for controlling transmission of blue (B) light can be input; and n pixels arranged in the (2k+1)-th row to n pixels arranged in the (2k+t)-th row, n pixels arranged in the (e+f−2k)-th row to n pixels arranged in the (e+f−2k−t+1)-th row, and n pixels arranged in the (e+f+2k+1)-th row to n pixels arranged in the (e+f+2k+t)-th row can be sequentially selected, and an image signal for controlling transmission of green (G) light can be input.

In a period (T2) following the period (T1), the n pixels arranged in the (t+1)-th row to the n pixels arranged in the 2t-th row, the n pixels arranged in the (e+f−t)-th row to the n pixels arranged in the (e+f−2t+1)-th row, and the n pixels arranged in the (e+f+t+1)-th row to the n pixels arranged in the (e+f+2t)-th row can be sequentially selected, and an image signal for controlling transmission of red (R) light can be input; the n pixels arranged in the (k+t+1)-th row to the n pixels arranged in the (k+2t)-th row, the n pixels arranged in the (e+f−k−t)-th row to the n pixels arranged in the (e+f−k−2t+1)-th row, and the n pixels arranged in the (e+f+k+t+1)-th row to the n pixels arranged in the (e+f+k+2t)-th row can be sequentially selected, and an image signal for controlling transmission of blue (B) light can be input; and the n pixels arranged in the (2k+t+1)-th row to the n pixels arranged in the (2k+2t)-th row, the n pixels arranged in the (e+f−2k−t)-th row to the n pixels arranged in the (e+f−2k−2t+1)-th row, and the n pixels arranged in the (e+f+2k+t+1)-th row to the n pixels arranged in the (e+f+2k+2t)-th row can be sequentially selected, and an image signal for controlling transmission of green (G) light can be input.

In the periods (T2 to T4), the backlight arrays which are arranged behind the region to which the image signals are input in the period (T1) are turned on. Specifically, the light source that emits red (R) light is turned on behind the n pixels arranged in the first row to the n pixels arranged in the t-th row, the n pixels arranged in the (e+f−t+1)-th row to the n pixels arranged in the (e+f)-th row, and the n pixels arranged in the (e+f+1)-th row to the n pixels arranged in the (e+f+t)-th row; the light source that emits blue (B) light is turned on behind the n pixels arranged in the (k+1)-th row to the n pixels arranged in the (k+t)-th row, the n pixels arranged in the (e+f−k−t+1)-th row to the n pixels arranged in the (e+f−k)-th row, and the n pixels arranged in the (e+f+k+1)-th row to the n pixels arranged in the (e+f+k+t)-th row; and the light source that emits green (G) light is turned on behind the n pixels arranged in the (2k+1)-th row to the n pixels arranged in the (2k+t)-th row, the n pixels arranged in the (e+f−2k−t+1)-th row to the n pixels arranged in the (e+f−2k)-th row, and the n pixels arranged in the (e+f+2k+1)-th row to the n pixels arranged in the (e+f+2k+t)-th row.

In the periods (T3 to T5), the backlight arrays which are arranged behind the region to which the image signals are input in the period (T2) are turned on. Specially, the light source that emits red (R) light is turned on behind the n pixels arranged in the (t+1)-th row to the n pixels arranged in the 2t-th row, the n pixels arranged in the (e+f−2t+1)-th row to the n pixels arranged in the (e+f−t)-th row, and the n pixels arranged in the (e+f+t+1)-th row to the n pixels arranged in the (e+f+2t)-th row; the light source that emits blue (B) light is turned on behind the n pixels arranged in the (k+t+1)-th row to the n pixels arranged in the (k+2t)-th row, the n pixels arranged in the (e+f−k−2t+1)-th row to the n pixels arranged in the (e+f−k−t)-th row, and the n pixels arranged in the (e+f+k+t+1)-th row to the n pixels arranged in the (e+f+k+2t)-th row; and the light source that emits green (G) light is turned on behind the n pixels arranged in the (2k+t+1)-th row to the n pixels arranged in the (2k+2t)-th row, the n pixels arranged in the (e+f−2k−2t+1)-th row to the n pixels arranged in the (e+f−2k−t)-th row, and the n pixels arranged in the (e+f+2k+t+1)-th row to the n pixels arranged in the (e+f+2k+2t)-th row.

Note that an image is formed in the pixel portion 10 by the operation from the input of an image signal for controlling transmission of red (R) light to the turning on of the light source that emits blue (B) light in the backlight array in a given region of the liquid crystal display device.

In this manner, in the scan line arranged in the first row to the scan line arranged in the e-th row, the image signal is input to the plurality of pixels arranged in a given region, and next the image signal is input to the plurality of pixels arranged in a region adjacent to one side of the given region, and each region is irradiated with light of a given color every time the input of the image signal to each region is finished. As a result, it is perceived by a user of the display device that an image is formed while the light of the given color moves to the direction along which the row number increases in the region from the first row to the e-th row.

Further, in the scan line arranged in the (e+f)-th row to the scan line arranged in the (e+1)-th row, the image signal is input to the plurality of pixels arranged in a given region, and next the image signal is input to the plurality of pixels arranged in a region adjacent to the other side of the given region, and each region is irradiated with light of a given color every time the input of the image signal to each region is finished. As a result, it is perceived by the user of the display device that an image is formed while the light of the given color moves to the direction along which the row number decreases in the region from the (e+1)-th row to the (e+f)-th row.

In the scan line arranged in the (e+f+1)-th row to the scan line arranged in the m-th row, the image signal is input to the plurality of pixels arranged in a given region, and next the image signal is input to the plurality of pixels arranged in a region adjacent to one side of the given region, and each region is irradiated with light of a given color every time the input of the image signal to each region is finished. As a result, it is perceived by the user of the display device that an image is formed while the light of the given color moves to the direction along which the row number increases in the region from the (e+f+1)-th row to the m-th row.

<Liquid Crystal Display Device Disclosed in this Embodiment>

As described above, in the liquid crystal display device, a range in which an image is drawn while light of a given color moves in one direction is divided by a range in which an image is drawn while light of the same color or light of a color different from the given color moves in a direction opposed to the one direction. As a result, a period in which the light of the given color continuously comes into the sight of the user can be decreased or the range can be narrowed even when the user moves the user's viewpoint in the one direction. With such a structure, overload of specific display information can be prevented, and a decrease in the display quality perceived by the user can be suppressed, whereby the quality of a display image can be improved.

The liquid crystal display device of this embodiment can perform input of an image signal and the turning on of a backlight in parallel. Therefore, it is possible to increase the frequency of input of an image signal to each pixel of the liquid crystal display device. Accordingly, color break generated in a field-sequential liquid crystal display device can be suppressed, and the quality of an image displayed by the liquid crystal display device can be improved.

The liquid crystal display device disclosed in this embodiment can achieve the above-mentioned operation while having a simple pixel configuration. Specifically, for a pixel of the liquid crystal display device disclosed in Patent Document 1, the transistor for controlling charge transfer is necessary in addition to the components of the pixel of the liquid crystal display device disclosed in this embodiment. Further, a signal line for controlling on/off of the transistor is also required. In contrast, a pixel configuration of the liquid crystal display device of this embodiment is simple. In other words, the liquid crystal display device of this embodiment can increase the aperture ratio of a pixel, as compared to the liquid crystal display device disclosed in Patent Document 1. Further, the number of wirings extending to a pixel portion is small, so that parasitic capacitance generated between various wirings can be decreased. In other words, various wirings extending to the pixel portion can operate at high speed.

Further, in the case where the backlight is turned on as the operation example in FIG. 12, colors of lights of backlight units adjacent to each other are not different from each other. Specifically, when the backlight is turned on in a region where an image signal is input in the period T1, which follows the image signal writing, the other backlight unit which is adjacent to the one backlight unit does not emit light of a different color. For example, in the period T1, when the light source that emits blue (B) light is turned on in the backlight unit for the (k+1)-th to (k+t)-th rows after the image signals for controlling transmission of blue (B) light are input to the n pixels arranged in the (k+1)-th row to the n pixels arranged in the (k+t)-th row, the light source that emits blue (B) light is turned on or emission itself is not performed (neither red (R) light nor green (G) light is emitted) in the backlight unit for the (3t+1)-th to k-th rows and the backlight unit for the (k+t+1)-th to (k+2t)-th rows. Thus, the probability of transmission of light of a color different from a given color through a pixel to which image data on the given color is input can be reduced.

It is also possible to provide a period in which two light sources that emit light of different colors in the backlight array are turned on at the same time. When a period in which two light sources are turned on at the same time is provided, it is possible to improve display luminance of the liquid crystal display device. Further, a lighting period of each of a plurality of light sources included in the backlight unit is ensured for a long period, whereby display color tones of the liquid crystal display device can be subdivided (shades of color to be displayed or the like can be expressed more finely). For example, not only a period in which any one of the light source that emits red (R) light, the light source that emits green (G) light, and the light source that emits blue (B) light is turned on but also a period in which two of them are turned on at the same time may be provided. For example, scanning of image signals (R→G→B→R+G→G+B→R+B) is performed six times, whereby it is possible to ensure a period in which the light source that emits red (R) light, the light source that emits green (G) light, and the light source that emits blue (B) light are each turned on three times. In other words, it is possible to increase a lighting period of each of the plurality of light sources efficiently. Accordingly, display color tones can be subdivided efficiently.

<Modification Example>

The liquid crystal display device described in this embodiment is one embodiment of the present invention, and the present invention includes a liquid crystal display device which is different from the above-described liquid crystal display device.

For example, the liquid crystal display device of this embodiment has a structure in which the pixel portion 10 is divided into nine regions and image signals are supplied in parallel to the nine regions; however, a liquid crystal display device according to one embodiment of the present invention is not limited to the structure. In other words, the liquid crystal display device according to one embodiment of the present invention can have a structure in which the pixel portion 10 is divided into a plurality of regions the number of which is not nine and image signals are supplied in parallel to the plurality of regions. In the case where the number of regions is changed, it is necessary to set clock signals for the scan line driver circuit and pulse-width control signals in accordance with the number of regions.

The liquid crystal display device of this embodiment includes a capacitor for retaining voltage applied to a liquid crystal element (see FIG. 2); however, it is possible not to include the capacitor. In this case, the aperture ratio of the pixel can be increased. Since a capacitor wiring extending to a pixel portion can be removed, various wirings extending to the pixel portion can operate at high speed.

Figure 13A:
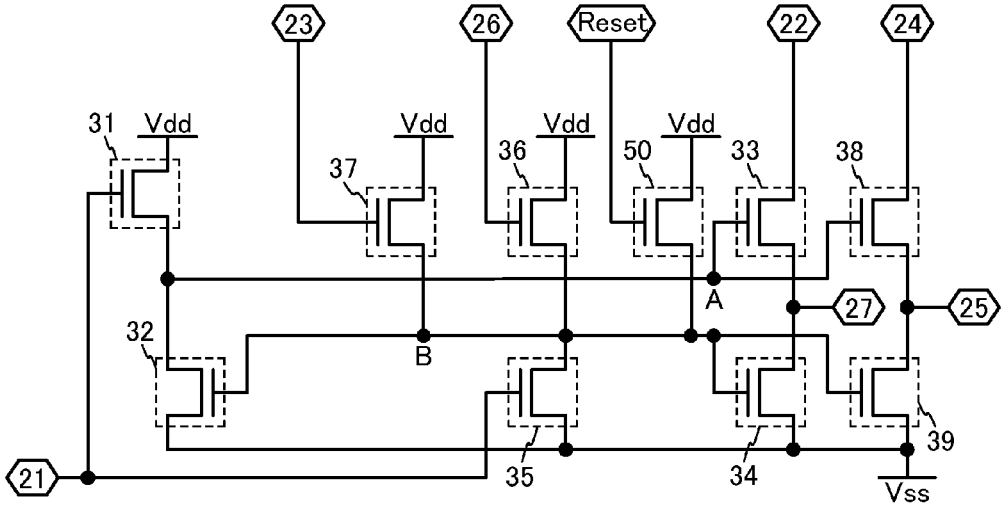
FIGS. 13A and 13B are circuit diagrams each illustrating an example of a pulse output circuit.

Further, the pulse output circuit can have a structure in which a transistor 50 is added to the pulse output circuit illustrated in FIG. 5A (see FIG. 13A). One of a source and a drain of the transistor 50 is electrically connected to the high power supply potential line; the other of the source and the drain of the transistor 50 is electrically connected to the gate of the transistor 32, the gate of the transistor 34, the other of the source and the drain of the transistor 35, the other of the source and the drain of the transistor 36, the other of the source and the drain of the transistor 37, and the gate of the transistor 39; and a gate of the transistor 50 is electrically connected to a reset terminal (Reset). To the reset terminal, the high-level potential is input in a period after an image is formed in the pixel portion; the low-level potential is input in the other period. Note that the high-level potential is input, whereby the transistor 50 is turned on. Thus, the potential of each node can be initialized, so that malfunction can be prevented. Note that in the case where the initialization is performed, it is necessary to provide an initialization period after the period in which an image is formed in the pixel portion. In the case where a period in which the backlight is turned off is provided after the period in which an image is formed in the pixel portion, the initialization can be performed in the period in which the backlight is turned off.

Figure 13B:
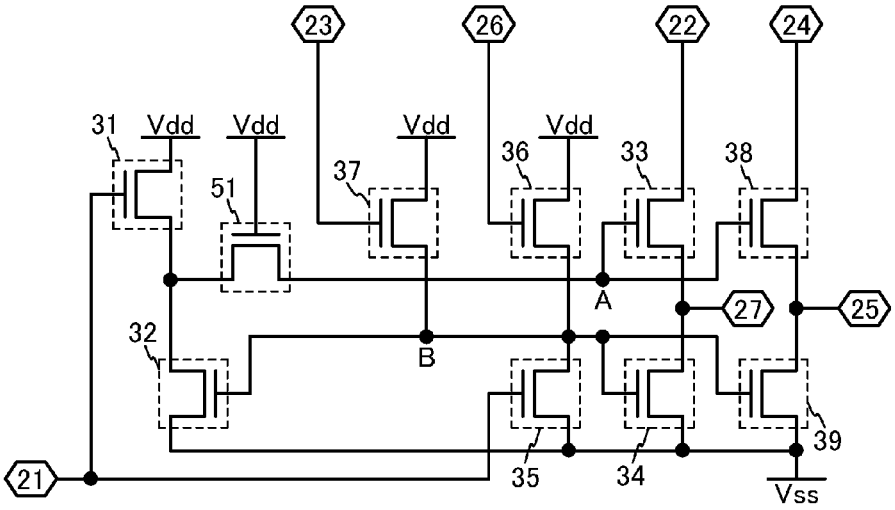

Further alternatively, the pulse output circuit can have a structure in which a transistor 51 is added to the pulse output circuit illustrated in FIG. 5A (see FIG. 13B). One of a source and a drain of the transistor 51 is electrically connected to the other of the source and the drain of the transistor 31 and the other of the source and the drain of the transistor 32; the other of the source and the drain of the transistor 51 is electrically connected to the gate of the transistor 33 and the gate of the transistor 38; and a gate of the transistor 51 is electrically connected to the high power supply potential line. The transistor 51 is turned off in a period in which the potential of the node A is at a high level (the periods t1 to t6 in FIGS. 3B to 3D). With the transistor 51, the gate of the transistor 33 and the gate of the transistor 38 can be electrically disconnected to the other of the source and the drain of the transistor 31 and the other of the source and the drain of the transistor 32 in the periods t1 to t6. Thus, a load at the time of the bootstrapping in the pulse output circuit can be reduced in the periods t1 to t6.

Figure 14A:
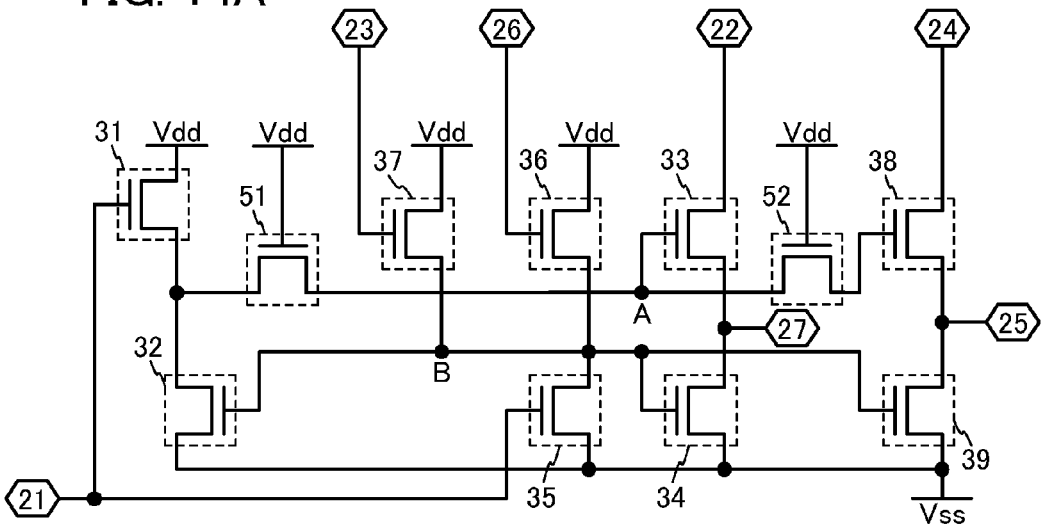
FIGS. 14A and 14B are circuit diagrams each illustrating an example of a pulse output circuit.

Further alternatively, the pulse output circuit can have a structure in which a transistor 52 is added to the pulse output circuit illustrated in FIG. 13B (see FIG. 14A). One of a source and a drain of the transistor 52 is electrically connected to the gate of the transistor 33 and the other of the source and the drain of the transistor 51; the other of the source and the drain of the transistor 52 is electrically connected to the gate of the transistor 38; and a gate of the transistor 52 is electrically connected to the high power supply potential line. As described above, a load at the time of the bootstrapping in the pulse output circuit can be reduced with the transistor 52. In particular, the load-reduction effect is large in the case where the potential of the node A is increased only by the capacitive coupling between the source and the gate of the transistor 33 (see FIG. 5D).

Figure 14B:
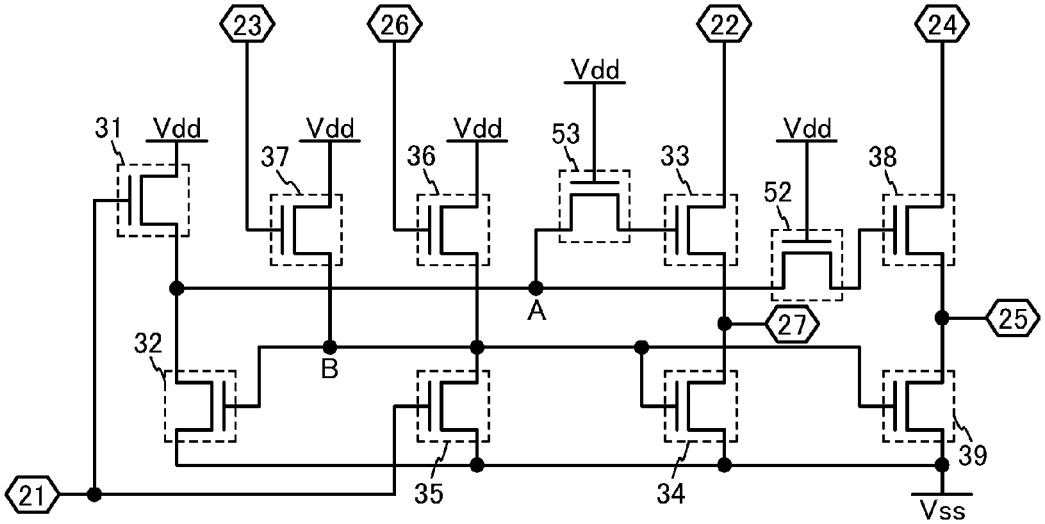

Further alternatively, the pulse output circuit can have a structure in which the transistor 51 is removed from the pulse output circuit illustrated in FIG. 14A and a transistor 53 is added to the pulse output circuit illustrated in FIG. 14A (see FIG. 14B). One of a source and a drain of the transistor 53 is electrically connected to the other of the source and the drain of the transistor 31, the other of the source and the drain of the transistor 32, and one of the source and the drain of the transistor 52; the other of the source and the drain of the transistor 53 is electrically connected to the gate of the transistor 33; and a gate of the transistor 53 is electrically connected to the high power supply potential line. As described above, with the transistor 53, a load at the time of the bootstrapping in the pulse output circuit can be reduced. Further, an effect of a fraud pulse generated in the pulse output circuit on the switching of the transistors 33 and 38 can be decreased.

Further, in the liquid crystal display device of this embodiment, the three kinds of light sources, that is, the light source that emits red (R) light, the light source that emits green (G) light, and the light source that emits blue (B) light are aligned linearly and horizontally as the backlight unit (see FIG. 10 and FIG. 11); however, the structure of the backlight unit is not limited to this. For example, the three kinds of light sources may be arranged triangularly, or linearly and longitudinally; or a red (R) backlight unit, a green (G) backlight unit, and a blue (B) backlight unit may be separately provided. Moreover, the above-described liquid crystal display device is provided with a direct-lit backlight as the backlight (see FIG. 10 and FIG. 11); alternatively, an edge-lit backlight can be used as the backlight.

The liquid crystal display device of this embodiment successively performs scanning of a selection signal and the turning on of the backlight unit (see FIG. 12); however, the operation of the liquid crystal display device is not limited to that of this structure. For example, before and after a period in which an image is formed in the pixel portion (the period corresponds to a period in which an input of an image signal for controlling transmission of red (R) light to the turning on of the light source that emits blue (B) light in the backlight unit are performed in FIG. 12), it is possible to provide a period in which scanning of a selection signal and the turning on of the backlight unit are not performed. Thus, color break generated in the liquid crystal display device can be suppressed and the quality of an image displayed by the liquid crystal display device can be improved. Note that the structure is changed into a structure in which neither scanning of a selection signal nor the turning on of the backlight unit are performed; however, a structure in which scanning of a selection signal is performed and an image signal for not transmitting light to each pixel is input can also be formed.

In the liquid crystal display device of this embodiment, it is possible to provide a period in which all three light sources included in the backlight unit are turned on as well as a period in which one or two light sources of three light sources included in the backlight unit is/are turned on per specific region in the pixel portion. In this case, it is possible to further improve display luminance of the liquid crystal display device and to subdivide display color tones of the liquid crystal display device. Note that an image is formed in the pixel portion by the operation from the input of the image signals for controlling transmission of red (R) light to the turning on of the light source that emits red (R) light, the light source that emits green (G) light, and the light source that emits blue (B) light in the backlight unit.

In the liquid crystal display device of this embodiment, an image is formed per specific region of the pixel portion by turning on of the light sources of the backlight unit in the following order: red (R)→green (G)→blue (B) (see FIG. 12). However, the order of turning on the light sources in the liquid crystal display device of this embodiment is not limited to the order. For example, it is possible to have a structure in which an image is formed by the following order of turning on the light sources; red (R)→green (G)→blue (B)→[red (R) and green (G)]→[green (G) and blue (B)]→[blue (B) and red (R)]; a structure in which an image is formed by the following order of turning on the light sources: blue (B)→[blue (B) and green (G)]→green (G)→[green (G) and red (R)]→red (R)→[red (R) and blue (B)]; a structure in which an image is formed by the following order of turning on the light sources: blue (B)→[blue (B) and red (R)]→red (R)→[red (R) and green (G)]→green (G)→[green (G) and blue (B)]; a structure in which an image is formed by the following order of turning on the light sources: blue (B)→[red (R) and green (G)]→green (G)→[blue (B) and red (R)]→red (R)→[green (G) and blue (B)]; a structure in which an image is formed by the following order of turning on the light sources: blue (B)→[red (R) and green (G)]→[blue (B) and green (G)]→red (R)→green (G)→[red (R) and blue (B)]; or the like. Note that it is needless to say that the input order of an image signal for controlling transmission of light of a specific color needs to be designed in accordance with the order of turning on the light source, as appropriate.

In the liquid crystal display device of this embodiment, the light source that emits red (R) light, the light source that emits green (G) light, and the light source that emits blue (B) light included in the backlight unit are each turned on once, whereby an image is formed (see FIG. 12); however, the number of turning on of the light sources in the liquid crystal display device of this embodiment can vary. For example, the backlight unit is turned on so that the light source that emits red (R) light and has a high luminosity factor and the light source that emits green (G) light are turned on twice and the light source that emits blue (B) light and has a low luminosity factor is turned on three times, whereby an image can be formed.

In the liquid crystal display device of this embodiment, the three kinds of light sources, that is, the light source that emits red (R) light, the light source that emits green (G) light, and the light source that emits blue (B) light are used in combination for the backlight; however, the liquid crystal display device according to one embodiment of the present invention is not limited to having this structure. In other words, in the liquid crystal display device according to one embodiment of the present invention, light sources that emit lights of different colors can be provided in combination to form a backlight unit. For example, four kinds of light sources, that is, the light source that emits red (R) light, the light source that emits green (G) light, the light source that emits blue (B) light, and a light source that emits white (W) light or four kinds of light sources, that is, light source that emits red (R) light, the light source that emits green (G) light, the light source that emits blue (B) light, and a light source that emits yellow (Y) light can be used in combination; or three kinds of light sources, that is, a light source that emits cyan (C) light, a light source that emits magenta (M) light, and the light source that emits yellow (Y) light can be used in combination. Note that in the case where a light source that emits white (W) light is included in the backlight unit, white (W) light can be formed not by a color mixture but by the light source. Because the light source has high luminous efficiency, a backlight is formed using the light source, whereby power consumption can be reduced. In the case where a backlight unit includes two kinds of light sources that emit complementary color lights (e.g., the case where two kinds of light sources, that is, the light source that emits blue (B) light, and the light source of yellow (Y) light), the lights of two color are mixed, whereby white (W) light can be formed. Moreover, it is possible to use a combination of six kinds of light sources, that is, a light source that emits pale red (R) light, a light source that emits pale green (G) light, a light source that emits pale blue (B) light, a light source that emits dark red (R) light, a light source that emits dark green (G) light, and a light source that emits dark blue (B) light; or a combination of six kinds of light sources, that is, the light source that emits red (R) light, the light source that emits green (G) light, the light source that emits blue (B) light, the light source that emits cyan (C) light, the light source that emits magenta (M) light, and the light source that emits yellow (Y) light. In such a manner, with a combination of a wider variety of light sources, the color gamut of the liquid crystal display device can be enlarged, and the image quality can be improved.

A plurality of structures described as the modification example of this embodiment can be applied to the liquid crystal display device of this embodiment.

This embodiment or part of this embodiment can be freely combined with the other embodiments or part of the other embodiments.

(Embodiment 2)

In this embodiment, a specific structure of the liquid crystal display device described in Embodiment 1 will be described.

<Specific Example of Transistor>

First, a specific example of a transistor used for the pixel portion or the various circuits of the liquid crystal display device described above will be described with reference to FIGS. 15A to 15D. Note that in the liquid crystal display device, the transistors provided in the pixel portion and the various circuits may have either the same structure or different structures.

Figure 15A:
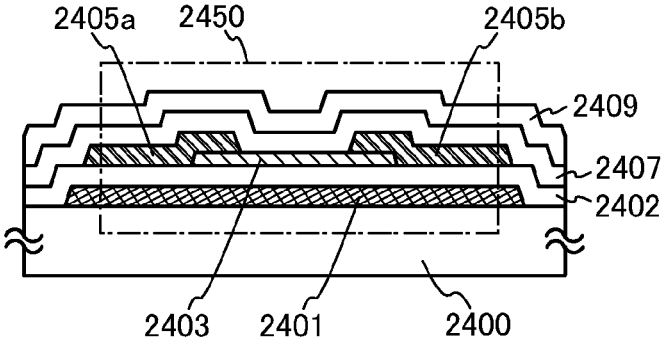
FIGS. 15A to 15D illustrate structure examples of a transistor.

A transistor 2450 in FIG. 15A includes a gate layer 2401 over a substrate 2400, a gate insulating layer 2402 over the gate layer 2401, a semiconductor layer 2403 over the gate insulating layer 2402, and a source layer 2405*a* and a drain layer 2405*b* over the semiconductor layer 2403. An insulating layer 2407 is formed over the semiconductor layer 2403, the source layer 2405*a*, and the drain layer 2405*b*. A protective insulating layer 2409 may be formed over the insulating layer 2407. The transistor 2450 is a bottom-gate transistor, and is also an inverted staggered transistor.

Figure 15B:
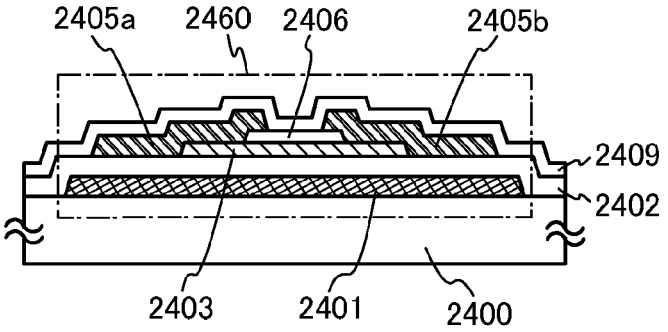

A transistor 2460 illustrated in FIG. 15B includes the gate layer 2401 over the substrate 2400, the semiconductor layer

2403 over the gate insulating layer 2402, a channel protective layer 2406 over the semiconductor layer 2403, and the source layer 2405*a* and the drain layer 2405*b* over the channel protective layer 2406 and the semiconductor layer 2403. The protective insulating layer 2409 may be formed over the source layer 2405*a* and the drain layer 2405*b*. The transistor 2460 is a bottom-gate transistor called a channel-protective type (also referred to as a channel-stop type) transistor and is also an inverted staggered transistor.

Figure 15C:
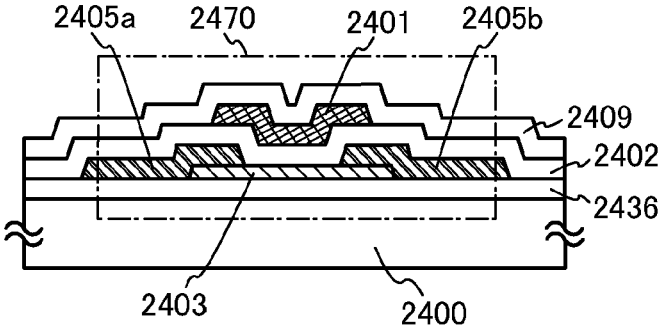

A transistor 2470 illustrated in FIG. 15C includes a base layer 2436 over the substrate 2400; the semiconductor layer 2403 over the base layer 2436; the source layer 2405*a* and the drain layer 2405*b* over the semiconductor layer 2403 and the base layer 2436; the gate insulating layer 2402 over the semiconductor layer 2403, the source layer 2405*a*, and the drain layer 2405*b*; and the gate layer 2401 over the gate insulating layer 2402. The protective insulating layer 2409 may be formed over the gate layer 2401. The transistor 2470 is a top-gate transistor.

Figure 15D:
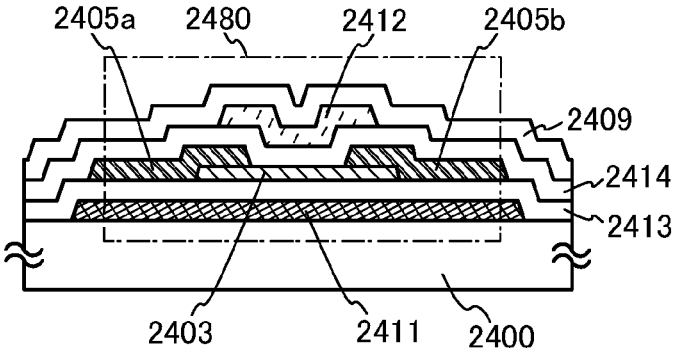

A transistor 2480 illustrated in FIG. 15D includes a first gate layer 2411 over the substrate 2400, a first gate insulating layer 2413 over the first gate layer 2411, the semiconductor layer 2403 over the first gate insulating layer 2413, and the source layer 2405*a* and the drain layer 2405*b* over the semiconductor layer 2403 and the first gate insulating layer 2413. A second gate insulating layer 2414 is formed over the semiconductor layer 2403, the source layer 2405*a*, and the drain layer 2405*b*, and a second gate layer 2412 is formed over the second gate insulating layer 2414. The protective insulating layer 2409 may be formed over the second gate layer 2412.

The transistor 2480 has a structure combining the transistor 2450 and the transistor 2470. The first gate layer 2411 and the second gate layer 2412 may be electrically connected to each other to function as one gate layer. One of the first gate layer 2411 and the second gate layer 2412 is referred to simply as a "gate", and the other of the first gate layer 2411 and the second gate layer 2412 is referred to simply as a "back gate" in some cases. Note that in the transistor 2480, the potential of the back gate is changed, whereby threshold voltage of the transistor 2480 can be changed when switching is controlled by the potential of the gate.

Note that examples of the substrate 2400 include a semiconductor substrate (e.g., a single crystal substrate or a silicon substrate), an SOI substrate, a glass substrate, a quartz substrate, a conductive substrate whose top surface is provided with an insulating layer, flexible substrates such as a plastic substrate, a bonding film, paper containing a fibrous material, and a base film. As an example of a glass substrate, a barium borosilicate glass substrate, an aluminoborosilicate glass substrate, soda lime glass substrate, and the like can be given. For a flexible substrate, a flexible synthetic resin such as plastics typified by poly(ethylene terephthalate) (PET), poly(ethylene naphthalate) (PEN), and poly(ether sulfone) (PES), or an acrylic resin can be used, for example.

For the gate layer 2401 and the first gate layer 2411, an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements can be used. A layered structure of these materials can also be used.

For the gate insulating layer 2402, the first gate insulating layer 2413, and the second gate insulating layer 2414, an insulator such as silicon oxide, silicon nitride, silicon oxynitride, silicon nitride oxide, aluminum oxide, tantalum oxide, or gallium oxide can be used. A layered structure of these materials can also be used. Note that silicon oxynitride refers to a substance which contains more oxygen than nitrogen and contains oxygen, nitrogen, silicon, and hydrogen at given concentrations ranging from 55 to 65 atomic %, 1 to 20 atomic %, 25 to 35 atomic %, and 0.1 to 10 atomic %, respectively, where the total percentage of atoms is 100 atomic %. Further, the silicon nitride oxide film refers to a film which contains more nitrogen than oxygen and contains oxygen, nitrogen, silicon, and hydrogen at given concentrations ranging from 15 to 30 atomic %, 20 to 35 atomic %, 25 to 35 atomic %, and 15 to 25 atomic %, respectively, where the total percentage of atoms is 100 atomic %.

The semiconductor layer 2403 can be formed using any of the following semiconductor materials, for example: a material containing an element belonging to Group 14 of the periodic table, such as silicon (Si) or germanium (Ge), as its main component; a compound such as silicon germanium (SiGe) or gallium arsenide (GaAs); an oxide such as zinc oxide (ZnO) or zinc oxide containing indium (In) and gallium (Ga); or an organic compound exhibiting semiconductor characteristics. A layered structure of layers formed using these semiconductor materials can also be used.

In the case where silicon (Si) is used for the semiconductor layer 2403, the crystal state of the semiconductor layer 2403 is not limited. In other words, any of amorphous silicon, microcrystalline silicon, polycrystalline silicon, and single crystal silicon can be used for the semiconductor layer 2403. The Raman spectrum of microcrystalline silicon is shifted to a lower wavenumber side than 520 $cm^{-1}$ that represents single crystal silicon. In other words, the peak of the Raman spectrum of the microcrystalline silicon exists between 520 $cm^{-1}$ which represents single crystal silicon and 480 $cm^{-1}$ which represents amorphous silicon. The microcrystalline silicon includes at least 1 atomic % or more of hydrogen or halogen to terminate dangling bonds. Moreover, the microcrystalline silicon may contain a rare gas element such as helium, argon, krypton, or neon to further promote lattice distortion, so that stability is increased and a favorable microcrystalline semiconductor can be obtained.

Moreover, in the case where an oxide (an oxide semiconductor) is used for the semiconductor layer 2403, any of the following oxide semiconductors can be used: an In—Sn—Ga—Zn—O-based oxide semiconductor which is an oxide of four metal elements; an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, and a Sn—Al—Zn—O-based oxide semiconductor which are oxides of three metal elements; an In—Ga—O-based oxide, an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, and an In—Mg—O-based oxide semiconductor which are oxides of two metal elements; and an In—O-based oxide semiconductor, a Sn—O-based oxide semiconductor, and a Zn—O-based oxide semiconductor which are oxides of one metal element. Further, $SiO_2$ may be contained in the above oxide semiconductor. Here, for example, the In—Ga—Zn—O-based oxide semiconductor means an oxide containing at least In, Ga, and Zn, and the composition ratio of the elements is not particularly limited. The In—Ga—Zn—O-based oxide semiconductor may contain an element other than In, Ga, and Zn.

As the oxide semiconductor, a thin film represented by the chemical formula, $InMO_3(ZnO)_m$ (m>0) can be used. Here, M represents one or more metal elements selected from Ga, Al, Mn, and Co. For example, M may be Ga, Ga and Al, Ga and Mn, Ga and Co, or the like.

For the source layer 2405*a*, the drain layer 2405*b*, and the second gate layer 2412, an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements can be used. A layered structure of these materials can also be used.

A conductive film to be the source layer 2405*a* and the drain layer 2405*b* (including a wiring layer formed using the same layer as the source and drain layers) may be formed using a conductive metal oxide. As the conductive metal oxide, indium oxide ($In_2O_3$), tin oxide ($SnO_2$), zinc oxide (ZnO), indium oxide-tin oxide alloy ($In_2O_3$—$SnO_2$; abbreviated to ITO), indium oxide-zinc oxide alloy ($In_2O_3$—ZnO), or any of these metal oxide materials in which silicon oxide is contained can be used.

As the channel protective layer 2406, an insulator such as silicon oxide, silicon nitride, silicon oxynitride, silicon nitride oxide, aluminum oxide, tantalum oxide, or gallium oxide can be used. A layered structure of these materials can also be used.

For the insulating layer 2407, an insulator such as silicon oxide, silicon oxynitride, aluminum oxide, aluminum oxynitride, or gallium oxide can be used. A layered structure of these materials can also be used.

For the protective insulating layer 2409, an insulator such as silicon nitride, aluminum nitride, silicon nitride oxide, or aluminum nitride oxide can be used. A layered structure of these materials can also be used.

As the base layer 2436, an insulator such as silicon oxide, silicon nitride, silicon oxynitride, silicon nitride oxide, aluminum oxide, tantalum oxide, or gallium oxide can be used. A layered structure of these materials can also be used.

In the case where an oxide semiconductor is used for the semiconductor layer 2403, an insulating layer in contact with the oxide semiconductor layer 2403 (here, corresponding to the gate insulating layer 2402, the insulating layer 2407, the channel protective layer 2406, the base layer 2436, the first gate insulating layer 2413, and the second gate insulating film 2414) is preferably formed of an insulating material including a Group 13 element and oxygen. Many of oxide semiconductor materials include a Group 13 element, and an insulating material including a Group 13 element works well with an oxide semiconductor. By using an insulating material including a Group 13 element for an insulating layer in contact with the oxide semiconductor, an interface with the oxide semiconductor can keep a favorable state.

An insulating material including a Group 13 element refers to an insulating material including one or more Group 13 elements. As the insulating material including a Group 13 element, gallium oxide, aluminum oxide, aluminum gallium oxide, and gallium aluminum oxide can be given for example. Here, aluminum gallium oxide refers to a material in which the amount of aluminum is larger than that of gallium in atomic percent, and gallium aluminum oxide refers to a material in which the amount of gallium is larger than or equal to that of aluminum in atomic percent.

For example, in the case of forming an insulating layer in contact with an oxide semiconductor layer containing gallium, a material including gallium oxide may be used as an insulating layer, so that favorable characteristics can be maintained at the interface between the oxide semiconductor layer and the insulating layer. When the oxide semiconductor layer and the insulating layer containing gallium oxide are provided in contact with each other, hydrogen pileup at the interface between the oxide semiconductor layer and the insulating layer can be reduced, for example. Note that a similar effect can be obtained in the case where an element in the same group as a constituent element of the oxide semiconductor is used in an insulating layer. For example, it is effective to form an insulating layer with the use of a material including aluminum oxide. Note that aluminum oxide has a property of not easily permeating water. Thus, it is preferable to use the material including aluminum oxide in terms of preventing entry of water to the oxide semiconductor layer.

In the case where an oxide semiconductor is used for the semiconductor layer 2403, the insulating material of the insulating layer in contact with the oxide semiconductor preferably includes oxygen in a proportion higher than that in the stoichiometric composition, by heat treatment under an oxygen atmosphere or oxygen doping or the like. "Oxygen doping" refers to addition of oxygen into a bulk (solid phase). Note that the term "bulk (solid phase)" is used in order to clarify that oxygen is added not only to a surface of a thin film but also to the inside of the thin film. In addition, "oxygen doping" includes "oxygen plasma doping" in which oxygen which is made to be plasma is added to a bulk. The oxygen doping may be performed using an ion implantation method or an ion doping method.

For example, in the case where the insulating layer is formed using gallium oxide, the composition of gallium oxide can be set to be $Ga_2O_x$ ($x=3+\alpha$, $0<\alpha<1$) by heat treatment under an oxygen atmosphere or oxygen doping.

In the case where the insulating layer is formed using aluminum oxide, the composition of aluminum oxide can be set to be $Al_2O_x$ ($x=3+\alpha$, $0<\alpha<1$) by heat treatment under an oxygen atmosphere or oxygen doping.

In the case where the insulating layer is formed using gallium aluminum oxide (aluminum gallium oxide), the composition of gallium aluminum oxide (aluminum gallium oxide) can be set to be $Ga_xAl_{2-x}O_{3+\alpha}$ ($0<x<2$, $0<\alpha<1$) by heat treatment under an oxygen atmosphere or oxygen doping.

By oxygen doping, an insulating layer which includes a region where the proportion of oxygen is higher than that in the stoichiometric composition can be formed. When the insulating layer including such a region is in contact with the oxide semiconductor layer, oxygen that exists excessively in the insulating layer is supplied to the oxide semiconductor layer, and oxygen deficiency in the oxide semiconductor layer or at an interface between the oxide semiconductor layer and the insulating layer is reduced. Thus, the oxide semiconductor layer can be formed to an i-type or substantially i-type oxide semiconductor.

Note that, in the case where an oxide semiconductor is used for the semiconductor layer 2403, one of insulating layers which are in contact with the semiconductor layer 2403 and are located on the upper side and the lower side may be an insulating layer which includes a region where the proportion of oxygen is higher than that in the stoichiometric composition. However, both the insulating layers are preferably insulating layers which each include a region where the proportion of oxygen is higher than that in the stoichiometric composition. The above-described effect can be enhanced with a structure where the semiconductor layer 2403 is provided between the insulating layers which each include a region where the proportion of oxygen is higher than that in the stoichiometric composition, which are used as the insulating layers in contact with the semiconductor layer 2403 and located on the upper side and the lower side of the semiconductor layer 2403.

In the case where an oxide semiconductor is used for the semiconductor layer 2403, the insulating layers on the upper side and the lower side of the semiconductor layer 2403 may include the same constituent element or different constituent elements. For example, the insulating layers on the upper side and the lower side may be both formed of gallium oxide whose composition is $Ga_2O_x$ ($x=3+\alpha$, $0<\alpha<1$). Alternatively, one of the insulating layers on the upper side and the lower side may be formed of gallium oxide whose composition is $Ga_2O_x$ ($x=3+\alpha$, $0<\alpha<1$) and the other may be formed of aluminum oxide whose composition is $Al_2O_x$ ($x=3+\alpha$, $0<\alpha<1$).

In the case where an oxide semiconductor is used for the semiconductor layer 2403, an insulating layer in contact with the semiconductor layer 2403 may be formed by stacking insulating layers which each include a region where the proportion of oxygen is higher than that in the stoichiometric composition. For example, the insulating layer on the upper side of the semiconductor layer 2403 may be formed as follows: gallium oxide whose composition is $Ga_2O_x$ ($x=3+\alpha$, $0<\alpha<1$) is formed and gallium aluminum oxide (aluminum gallium oxide) whose composition is $Ga_xAl_{2-x}O_{3+\alpha}$ ($0<X<2$, $0<\alpha<1$) may be formed thereover. Note that the insulating layer on the lower side of the semiconductor layer 2403 may be formed by stacking insulating layers which each include a region where the proportion of oxygen is higher than that in the stoichiometric composition. Further, both of the insulating layers on the upper side and the lower side of the semiconductor layer 2403 may be formed by stacking insulating layers which each include a region where the proportion of oxygen is higher than that in the stoichiometric composition.

<Specific Example of Layout of Pixel>

Figure 16:
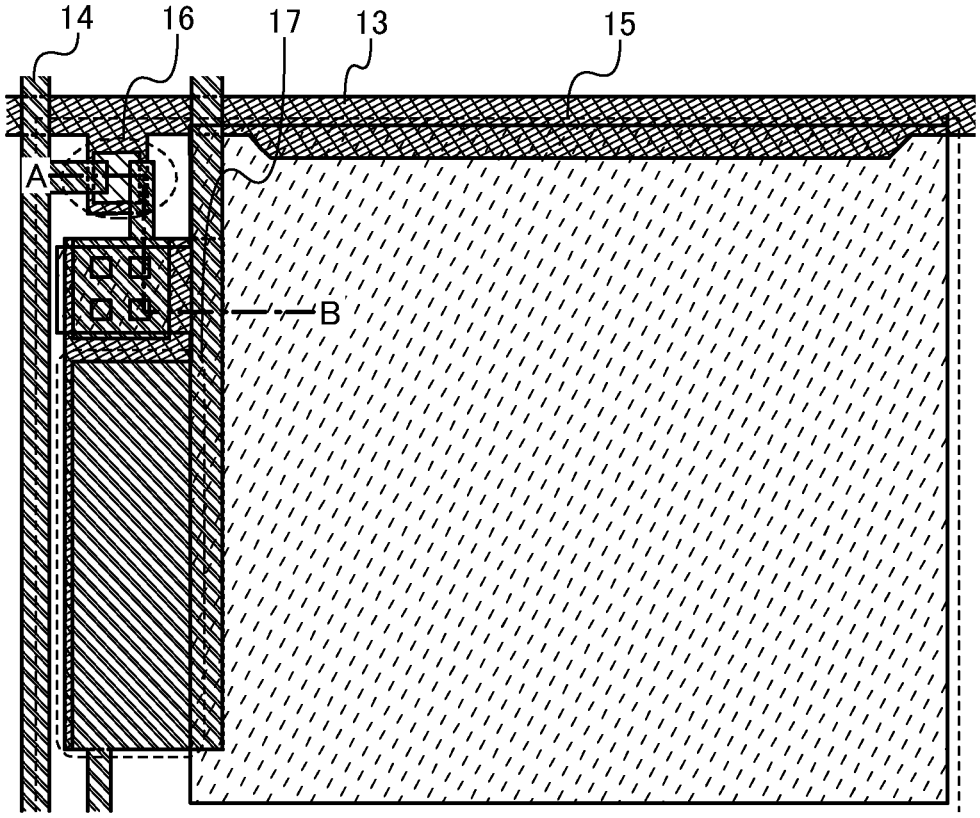
FIG. 16 is a top view of a specific example of a layout of a pixel.
Figure 17:
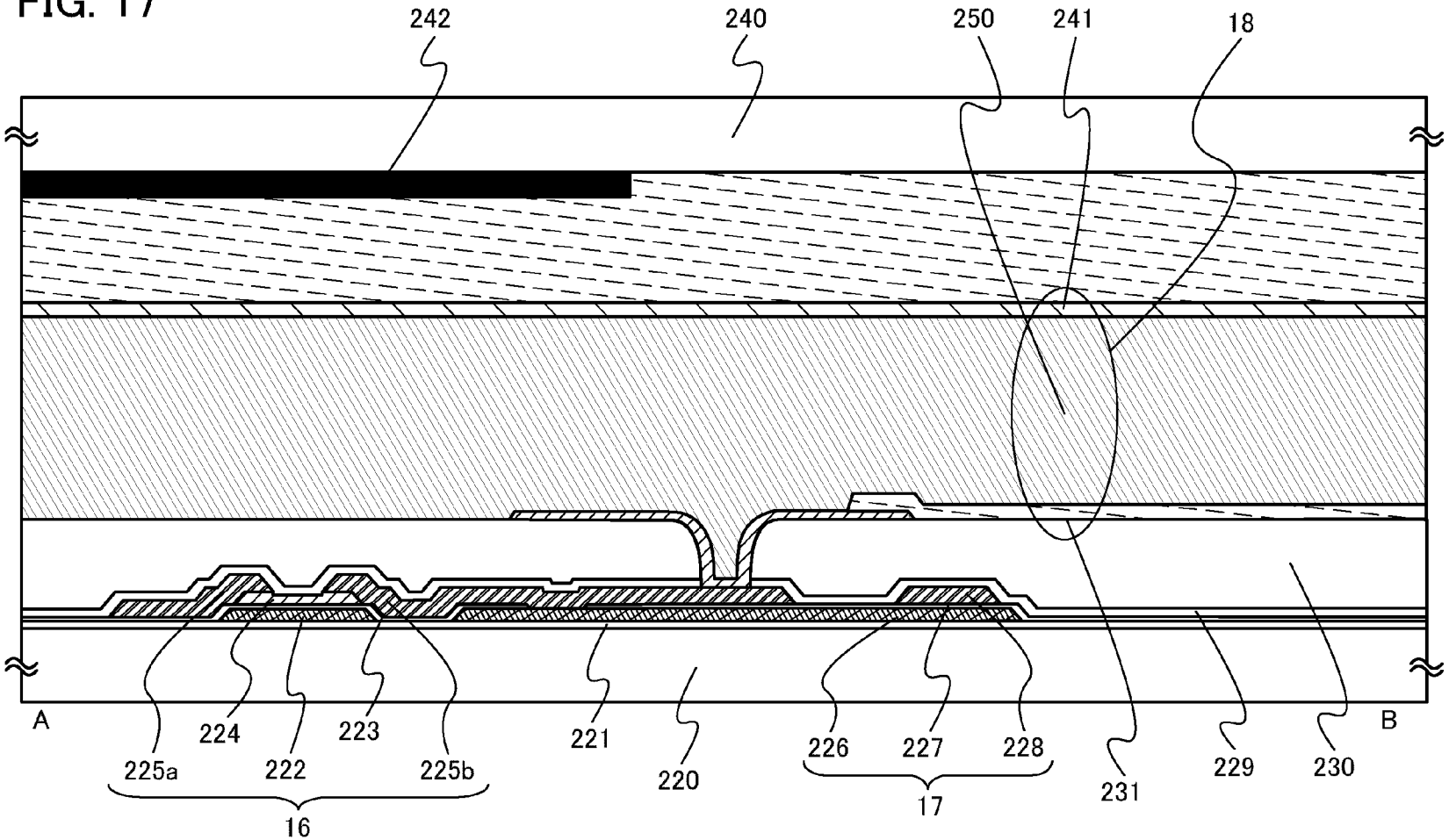
FIG. 17 is a cross-sectional view of a specific example of a layout of a pixel.

Next, specific examples of a layout of pixels in the above-described liquid crystal display device will be described with reference to FIG. 16 and FIG. 17. Note that FIG. 16 is a top view of a layout of the pixel illustrated in FIG. 2. FIG. 17 is a cross-sectional view taken along line A-B in FIG. 16. Note that structures of a liquid crystal layer, a counter electrode, and the like are omitted in FIG. 16. Hereinafter, a specific structure will be described with reference to FIG. 17.

The transistor 16 includes a conductive layer 222 provided over a substrate 220 with an insulating layer 221 interposed therebetween, an insulating layer 223 provided over the conductive layer 222, a semiconductor layer 224 which is over the conductive layer 222 and provided with the insulating layer 223 interposed therebetween, a conductive layer 225*a* provided over one end of the semiconductor layer 224, and a conductive layer 225*b* provided over the other end of the semiconductor layer 224. Note that the conductive layer 222 functions as a gate layer. The insulating layer 223 functions as a gate insulating layer. One of the conductive layer 225*a* and the conductive layer 225*b* functions as a source layer, and the other of the conductive layer 225*a* and the conductive layer 225*b* functions as a drain layer.

The capacitor 17 includes a conductive layer 226 provided over the substrate 220 with the insulating layer 221 interposed therebetween, an insulating layer 227 provided over the conductive layer 226, and a conductive layer 228 provided over the conductive layer 226 with the insulating layer 227 interposed therebetween. Note that the conductive layer 226 functions as one of electrodes of the capacitor 17. The insulating layer 227 functions as a dielectric of the capacitor 17. The conductive layer 228 functions as the other of the electrodes of the capacitor 17. The conductive layer 226 is formed using the same material as the conductive layer 222. The insulating layer 227 is formed using the same material as the insulating layer 223. The conductive layer 228 is formed using the same material as the conductive layer 225*a* and the conductive layer 225*b*. The conductive layer 226 is electrically connected to the conductive layer 225*b*.

Note that an insulating layer 229 and a planarization insulating layer 230 are provided over the transistor 16 and the capacitor 17.

The liquid crystal element 18 includes a transparent conductive layer 231 provided over the planarization insulating layer 230, a transparent conductive layer 241 provided on a counter substrate 240, and a liquid crystal layer 250 interposed between the transparent conductive layer 231 and the transparent conductive layer 241. Note that the transparent conductive layer 231 functions as a pixel electrode of the liquid crystal element 18. The transparent conductive layer 241 functions as a counter electrode of the liquid crystal element 18. The transparent conductive layer 231 is electrically connected to the conductive layer 225*b* and the conductive layer 226.

Note that an alignment film may be provided as appropriate between the transparent conductive layer 231 and the liquid crystal layer 250 or between the transparent conductive layer 241 and the liquid crystal layer 250. The alignment film can be formed using an organic resin such as polyimide or poly (vinyl alcohol). Alignment treatment such as rubbing is performed on the surface in order to align liquid crystal molecules in a certain direction. Rubbing can be performed by rolling a roller wrapped with a cloth of nylon or the like while being in contact with the alignment film and the surface of the alignment film is rubbed in a certain direction. Note that it is also possible to form the alignment film that has alignment characteristics with the use of an inorganic material such as silicon oxide by an evaporation method, without alignment treatment.

Injection of liquid crystal for forming the liquid crystal layer 250 may be performed by a dispenser method (dropping method) or a dipping method (pumping method).

Note that a light-blocking layer 242 which can block light is formed on the counter substrate 240 so that disclination caused by disorder of alignment of the liquid crystals between pixels is prevented from being observed or diffusion light is prevented from entering a plurality of pixels which is adjacent to each other in parallel. The light-blocking layer 242 can be formed using an organic resin containing a black pigment such as a carbon black or a low-valent titanium oxide whose oxidation number is smaller than that of titanium dioxide. Alternatively, a film formed using chromium can be used for the light-blocking layer 242.

The transparent conductive layer 231 and the transparent conductive layer 241 can be formed using a light-transmitting conductive material such as indium tin oxide including silicon oxide (ITSO), indium tin oxide (ITO), zinc oxide (ZnO), indium zinc oxide (IZO), or gallium-doped zinc oxide (GZO), for example.

Note that FIG. 17 illustrates a liquid crystal element with a structure where the liquid crystal layer 250 is provided between the transparent conductive layer 231 and the transparent conductive layer 241; however, the structure of the liquid crystal display device according to one embodiment of the present invention is not limited to this structure. A pair of electrodes may be formed over one substrate as in an IPS liquid crystal element or a liquid crystal element using a blue phase.

<Specific Example of Liquid Crystal Display Device>

Figure 18A:
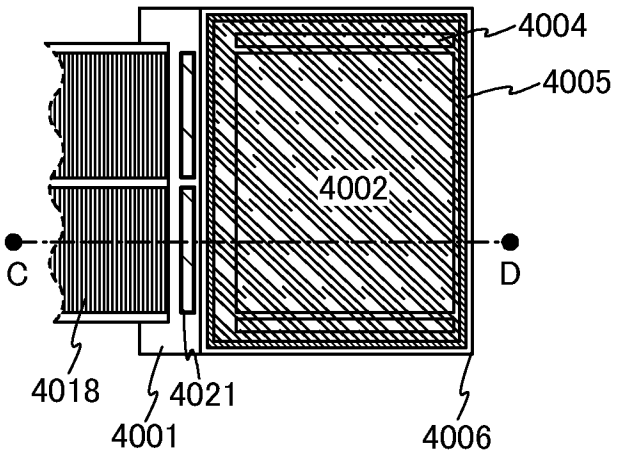
FIG. 18A is a top view of a specific example of a liquid crystal display device.
Figure 18B:
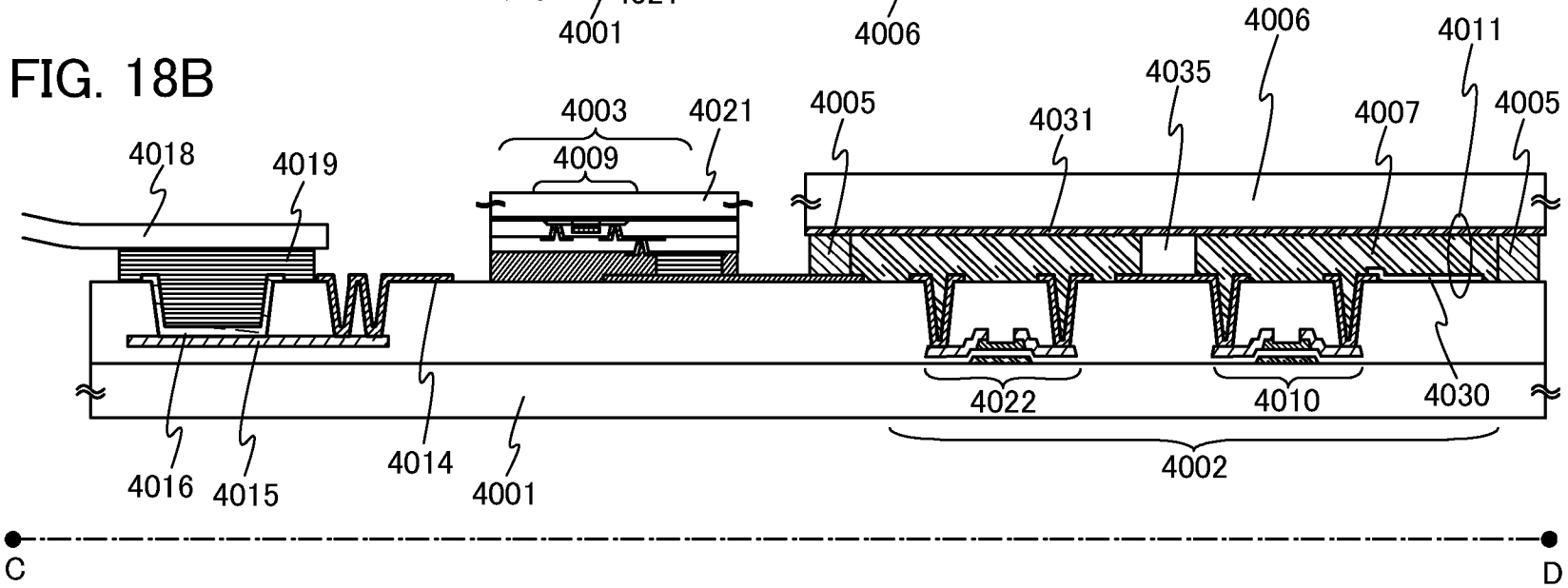
FIG. 18B is a cross-sectional view of the specific example of the liquid crystal display device.

Next, an appearance of a panel of a liquid crystal display device will be described with reference to FIGS. 18A and 18B. FIG. 18A is a top view of a panel where a substrate 4001 and a counter substrate 4006 are bonded to each other with a sealant 4005. FIG. 18B corresponds to a cross-sectional view taken along C-D in FIG. 18A.

The sealant 4005 is provided so as to surround a pixel portion 4002 and a scan line driver circuit 4004 provided over the substrate 4001. In addition, the counter substrate 4006 is provided over the pixel portion 4002 and the scan line driver circuit 4004. Thus, the pixel portion 4002 and the scan line driver circuit 4004 are sealed together with liquid crystals 4007 by the substrate 4001, the sealant 4005, and the counter substrate 4006.

A substrate 4021 provided with a signal line driver circuit 4003 is mounted in a region which is different from a region surrounded by the sealant 4005 over the substrate 4001. FIG. 18B illustrates a transistor 4009 included in the signal line driver circuit 4003.

A plurality of transistors is included in the pixel portion 4002 and the scan line driver circuit 4004 which are provided over the substrate 4001. FIG. 18B illustrates transistors 4010 and 4022 which are included in the pixel portion 4002.

A pixel electrode 4030 included in a liquid crystal element 4011 is electrically connected to the transistor 4010. A counter electrode 4031 of the liquid crystal element 4011 is formed on the counter substrate 4006. A portion where the pixel electrode 4030, the counter electrode 4031, and the liquid crystal 4007 overlap with each other corresponds to the liquid crystal element 4011.

A spacer 4035 is provided in order to control a distance (cell gap) between the pixel electrode 4030 and the counter electrode 4031. Note that although FIG. 18B illustrates the case where the spacer 4035 is obtained by patterning of an insulating film, a spherical spacer may be used.

A variety of signals and potentials are supplied to the signal line driver circuit 4003, the scan line driver circuit 4004, and the pixel portion 4002 from a connection terminal 4016 through lead wirings 4014 and 4015. The connection terminal 4016 is electrically connected to a terminal of an FPC 4018 through an anisotropic conductive film 4019.

Note that as the substrate 4001, the counter substrate 4006, and the substrate 4021, glass, ceramics, or plastics can be used. Plastics include a fiberglass-reinforced plastic (FRP) plate, a poly(vinyl fluoride) (PVF) film, a polyester film, an acrylic resin film, and the like.

Note that a light-transmitting material such as a glass plate, plastics, a polyester film, or an acrylic resin film is used for a substrate which is positioned in a direction in which light is extracted through the liquid crystal element 4011.

Figure 19:
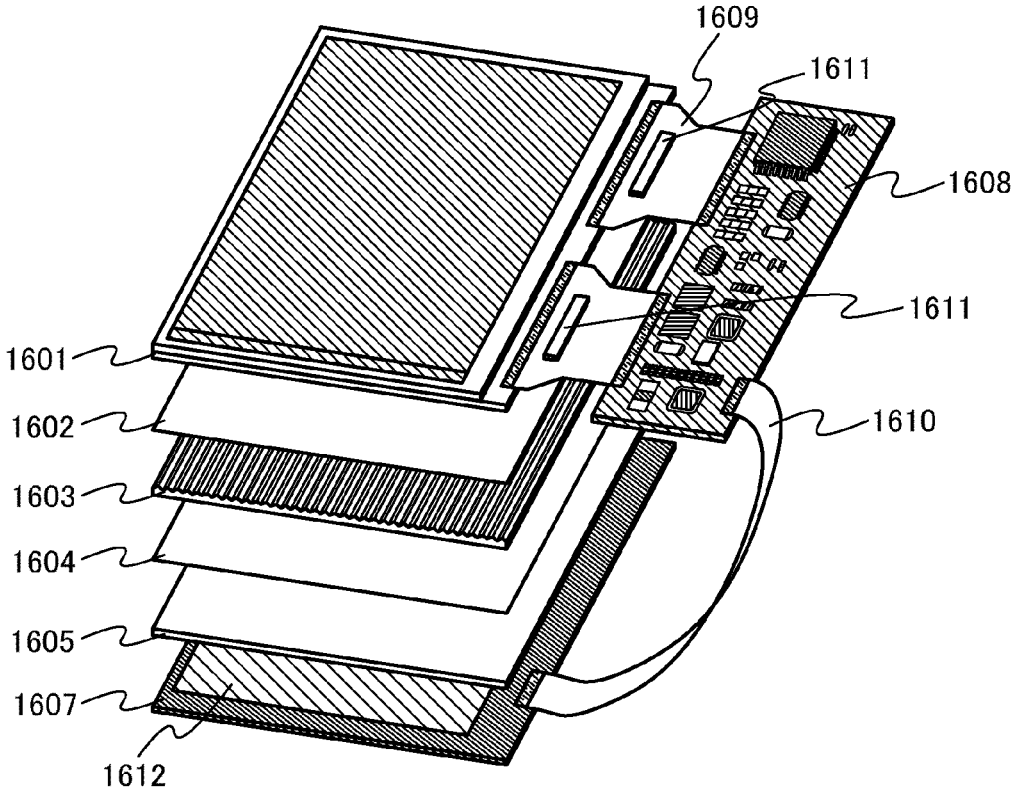
FIG. 19 is a perspective view of a specific example of a liquid crystal display device.

FIG. 19 is an example of a perspective view of the structure of the liquid crystal display device according to one embodiment of the present invention. The liquid crystal display device illustrated in FIG. 19 includes a panel 1601 including a pixel portion, a first diffusion plate 1602, a prism sheet 1603, a second diffusion plate 1604, a light guide plate 1605, a backlight panel 1607, a circuit board 1608, and substrates 1611 provided with signal line driver circuits.

The panel 1601, the first diffusion plate 1602, the prism sheet 1603, the second diffusion plate 1604, the light guide plate 1605, and the backlight panel 1607 are sequentially stacked. The backlight panel 1607 includes a backlight 1612 including a plurality of backlight units. Light from the backlight 1612 that is diffused in the light guide plate 1605 is delivered to the panel 1601 through the first diffusion plate 1602, the prism sheet 1603, and the second diffusion plate 1604.

Although the first diffusion plate 1602 and the second diffusion plate 1604 are used in this embodiment, the number of diffusion plates is not limited to two. The number of diffusion plates may be one, or may be three or more. It is acceptable as long as the diffusion plate is provided between the light guide plate 1605 and the panel 1601. Thus, the diffusion plate may be provided only on a side closer to the panel 1601 than the prism sheet 1603, or may be provided only on a side closer to the light guide plate 1605 than the prism sheet 1603.

Further, the shape of the cross section of the prism sheet 1603 is not limited to a sawtooth shape illustrated in FIG. 19, but may be a shape with which light from the light guide plate 1605 can be concentrated on the panel 1601 side.

The circuit board 1608 includes a circuit for generating various kinds of signals to be input to the panel 1601, a circuit for processing the signals, and the like. In addition, in FIG. 19, the circuit board 1608 and the panel 1601 are connected to each other via COF tapes 1609. Further, the substrates 1611 provided with the signal line driver circuits are connected to the COF tapes 1609 by a chip on film (COF) method.

FIG. 19 illustrates an example in which the circuit board 1608 is provided with a control circuit which controls driving of the backlight 1612 and the control circuit and the backlight panel 1607 are connected to each other through an FPC 1610. Note that the control circuit may be formed over the panel 1601. In that case, the panel 1601 and the backlight panel 1607 are connected to each other through an FPC or the like.

<Various Kinds of Electronic Devices Including Liquid Crystal Display Device>

Examples of electronic devices each including the liquid crystal display device disclosed in this specification will be described below with reference to FIGS. 20A to 20F.

Figure 20A:
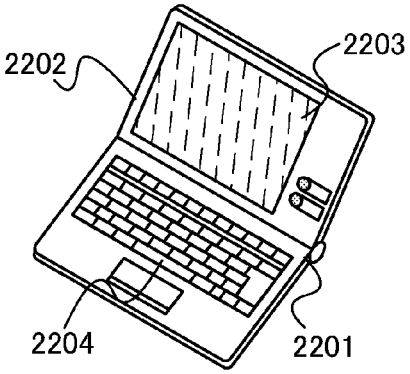
FIGS. 20A to 20F are diagrams illustrating examples of electronic devices.

FIG. 20A illustrates a laptop personal computer, which includes a main body 2201, a housing 2202, a display portion 2203, a keyboard 2204, and the like.

Figure 20B:
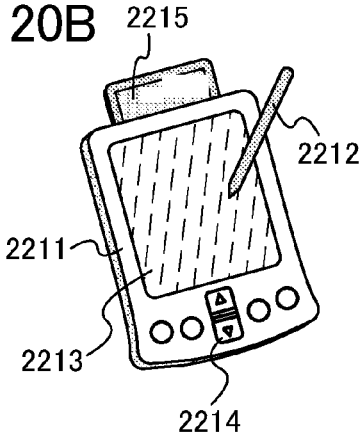

FIG. 20B illustrates a portable information terminal (PDA), which includes a main body 2211 provided with a display portion 2213, an external interface 2215, operation buttons 2214, and the like. Further, a stylus 2212 for operation is included as an accessory.

Figure 20C:
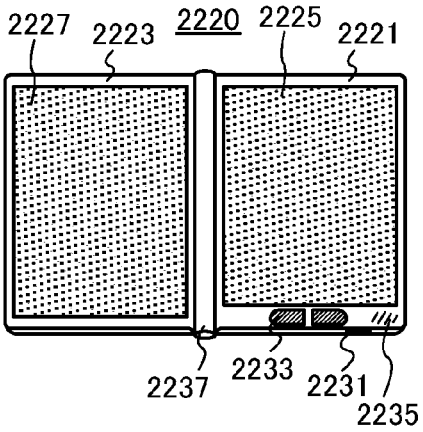

FIG. 20C illustrates an e-book reader 2220. The e-book reader 2220 includes two housings 2221 and 2223. The housings 2221 and 2223 are combined with each other with a hinge 2237 so that the e-book reader 2220 can be opened and closed with the hinge 2237 used as an axis. With such a structure, the e-book reader 2220 can be used like a paper book.

A display portion 2225 is incorporated in the housing 2221, and a display portion 2227 is incorporated in the housing 2223. The display portions 2225 and 2227 may display one image or different images. In the case where the display portions 2225 and 2227 display different images, for example, a display portion on the right side (the display portion 2225 in FIG. 20C) can display text and a display portion on the left side (the display portion 2227 in FIG. 20C) can display images.

Further, in FIG. 20C, the housing 2221 includes an operation portion and the like. For example, the housing 2221 includes a power button 2231, operation keys 2233, a speaker 2235, and the like. With the operation key 2233, pages can be turned. Note that a keyboard, a pointing device, or the like may be provided on the same surface as the display portion of the housing. Further, an external connection terminal (e.g., an earphone terminal, a USB terminal, or a terminal which can be connected to an AC adapter or a variety of cables such as USB cables), a recording medium insertion portion, or the like may be provided on a back surface or a side surface of the housing. Furthermore, the e-book reader 2220 may function as an electronic dictionary.

The e-book reader 2220 may transmit and receive data wirelessly. Through wireless communication, desired book data or the like can be purchased and downloaded from an electronic book server.

Figure 20D:
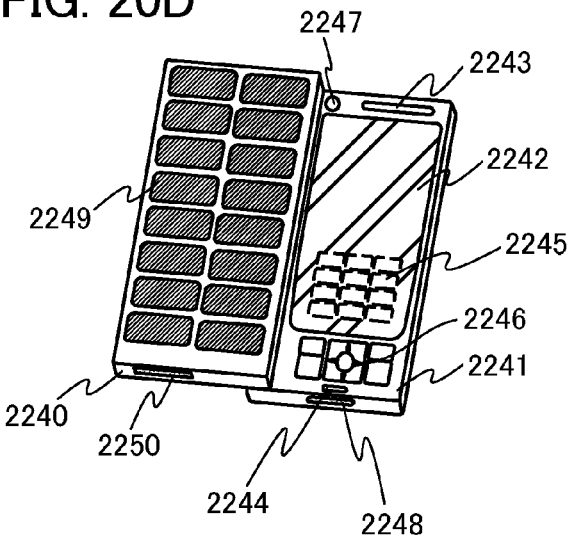

FIG. 20D illustrates a cellular phone. The cellular phone includes two housings 2240 and 2241. The housing 2241 includes a display panel 2242, a speaker 2243, a microphone 2244, a pointing device 2246, a camera lens 2247, an external connection terminal 2248, and the like. The housing 2240 includes a solar cell 2249 for storing electricity in the cellular phone, an external memory slot 2250, and the like. Further, an antenna is incorporated in the housing 2241.

The display panel 2242 has a touch panel function. A plurality of operation keys 2245 which are displayed as images are indicated by dashed lines in FIG. 20D. Note that the cellular phone includes a booster circuit for raising voltage output from the solar cell 2249 to voltage needed for each circuit. Further, the cellular phone can include a contactless IC chip, a small recording device, or the like in addition to the above components.

The display direction of the display panel 2242 is changed as appropriate in accordance with applications. Further, the camera lens 2247 is provided on the same surface as the display panel 2242; thus, the cellular phone can be used as a video phone. The speaker 2243 and the microphone 2244 can be used for videophone calls, recording, and playing sound, and the like as well as voice calls. Furthermore, the housings 2240 and 2241 which are developed as illustrated in FIG. 20D can overlap with each other by sliding; thus, the size of the cellular phone can be decreased, which makes the cellular phone suitable for being carried.

The external connection terminal 2248 can be connected to an AC adapter or a variety of cables such as USB cables, so that electricity can be stored and data communication can be performed. In addition, a larger amount of data can be saved and moved by insertion of a recording medium in the external memory slot 2250. Further, in addition to the above functions, the cellular phone may have an infrared communication function, a television reception function, or the like.

Figure 20E:
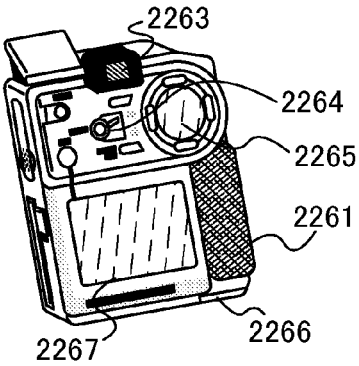

FIG. 20E illustrates a digital camera. The digital camera includes a main body 2261, a display portion A 2267, an eyepiece portion 2263, an operation switch 2264, a display portion B 2265, a battery 2266, and the like.

Figure 20F:
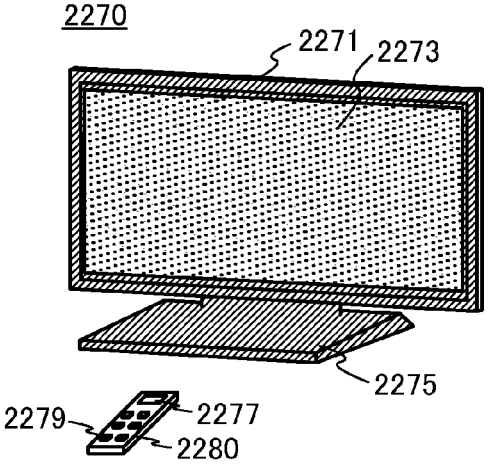

FIG. 20F illustrates a television set. A television set 2270 includes a display portion 2273 incorporated in a housing 2271. The display portion 2273 can display images. Note that here, the housing 2271 is supported by a stand 2275.

The television set 2270 can be operated by an operation switch of the housing 2271 or a remote control 2280. Channels and volume can be controlled with operation keys 2279 of the remote control 2280, so that an image displayed on the display portion 2273 can be controlled. Further, the remote control 2280 may have a display portion 2277 for displaying data output from the remote control 2280.

Note that the television set 2270 preferably includes a receiver, a modem, and the like. A general television broadcast can be received with the receiver. Further, when the television set is connected to a communication network with or without wires via the modem, one-way (from a transmitter to a receiver) or two-way (between a transmitter and a receiver or between receivers) data communication can be performed.

This application is based on Japanese Patent Application serial no. 2010-176027 filed with the Japan Patent Office on Aug. 5, 2010, the entire contents of which are hereby incorporated by reference.

What is claimed is:

1. A driving method of a liquid crystal display device comprising a pixel portion comprising a plurality of pixels arranged in a matrix of m rows and n columns (m and n are natural numbers greater than or equal to 4), the driving method comprising the steps of:

inputting a first image signal for a first color to the plurality of pixels in a first row;

irradiating the plurality of pixels in the first row with light of the first color by switching a first light source from an off state to an on state and inputting a second image signal for the first color to the plurality of pixels in a second row at the same time after the step of inputting the first image signal;

inputting a third image signal for a second color to the plurality of pixels in an (e+f−2k)-th row; and irradiating the plurality of pixels in the (e+f−2k)-th row with light of the second color by switching a second light source from an off state to an on state and inputting a fourth image signal for the second color to the plurality of pixels in an (e+f−2k−1)-th row at the same time after the step of inputting the third image signal, inputting a fifth image signal for the first color to the plurality of pixels in an (e+f+1)-th row;

irradiating the plurality of pixels in the (e+f+1)-th row with light of the first color by switching a third light source from an off state to an on state and inputting a sixth image signal for the first color to the plurality of pixels in an (e+f+2)-th row at the same time after the step of inputting the fifth image signal, wherein the pixel portion comprises a first range comprising a plurality of pixels arranged in a matrix of e rows and n columns, wherein the pixel portion comprises a second range comprising a plurality of pixels arranged in a matrix of f rows and n columns, wherein the pixel portion comprises a third range comprising a plurality of pixels arranged in a matrix of (m−e−f) rows and n columns, wherein k is less than e/2 and a multiple of 4, wherein image signals for the first color are sequentially supplied to the rows in descending order by one row in the first range, wherein image signals for the second color are sequentially supplied to the rows in ascending order by one row in the second range, wherein image signals for the first color are sequentially supplied to the rows in descending order by one row in the third range, wherein the switching of the first light source and the switching of the second light source are performed at a same time, and wherein the first color is different from the second color.

2. The driving method of a liquid crystal display device according to claim 1, wherein the first color and the second color each are red, green, or blue.

3. The driving method of a liquid crystal display device according to claim 1, wherein the liquid crystal display device comprises a plurality of backlight units, wherein each of the plurality of backlight units comprises three light sources each of which emits red light, green light, or blue light, and wherein the first color or the second color is generated by mixing lights emitted from any two of the light sources included in each of the plurality of backlight units.

4. The driving method of a liquid crystal display device according to claim 1, wherein the liquid crystal display device comprises a plurality of backlight units, wherein each of the plurality of backlight units comprises three light sources each of which emits red light, green light, or blue light, and wherein the three light sources are aligned linearly.

5. The driving method of a liquid crystal display device according to claim 1, wherein the liquid crystal display device comprises a plurality of backlight units, wherein each of the plurality of backlight units comprises three light sources each of which emits red light, green light, or blue light, and wherein the three light sources are aligned triangularly.

6. The driving method of a liquid crystal display device according to claim 1, wherein the liquid crystal display device comprises a plurality of backlight units, and wherein each of the plurality of backlight units comprises an organic light-emitting diode.

7. A driving method of a liquid crystal display device comprising a pixel portion comprising a plurality of pixels arranged in a matrix of m rows and n columns (m and n are natural numbers greater than or equal to 4), the driving method comprising the steps of:

inputting a first image signal for a first color to the plurality of pixels in a first row;

irradiating the plurality of pixels in the first row with light of the first color by switching a first light source from an off state to an on state and inputting a second image signal for the first color to the plurality of pixels in a second row after the step of inputting the first image signal;

inputting a third image signal for a second color to the plurality of pixels in an (e+f−2k)-th row; and irradiating the plurality of pixels in the (e+f−2k)-th row with light of the second color by switching a second light source from an off state to an on state and inputting a fourth image signal for the second color to the plurality of pixels in an (e+f−2k−1)-th row after the step of inputting the third image signal, inputting a fifth image signal for the first color to the plurality of pixels in an (e+f+1)-th row;

irradiating the plurality of pixels in the (e+f+1)-th row with light of the first color by switching a third light source from an off state to an on state and inputting a sixth image signal for the first color to the plurality of pixels in an (e+f+2)-th row after the step of inputting the fifth image signal, wherein the pixel portion comprises a first range comprising a plurality of pixels arranged in a matrix of e rows and n columns, wherein the pixel portion comprises a second range comprising a plurality of pixels arranged in a matrix of f rows and n columns, wherein the pixel portion comprises a third range comprising a plurality of pixels arranged in a matrix of (m−e−f) rows and n columns, wherein k is less than e/2 and a multiple of 4, wherein image signals for the first color are sequentially supplied to the rows in descending order by one row in the first range, wherein image signals for the second color are sequentially supplied to the rows in ascending order by one row in the second range, wherein image signals for the first color are sequentially supplied to the rows in descending order by one row in the third range, wherein the switching of the first light source, the switching of the second light source and the switching of the third light source are performed at a same time, and wherein the first color is different from the second color.

8. The driving method of a liquid crystal display device according to claim 7, wherein the first color and the second color each are red, green, or blue.

9. The driving method of a liquid crystal display device according to claim 7, wherein the liquid crystal display device comprises a plurality of backlight units, wherein each of the plurality of backlight units comprises three light sources each of which emits red light, green light, or blue light, and wherein the first color or the second color is generated by mixing lights emitted from any two of the light sources included in each of the plurality of backlight units.

10. The driving method of a liquid crystal display device according to claim 7, wherein the liquid crystal display device comprises a plurality of backlight units, wherein each of the plurality of backlight units comprises three light sources each of which emits red light, green light, or blue light, and wherein the three light sources are aligned linearly.

11. The driving method of a liquid crystal display device according to claim 7, wherein the liquid crystal display device comprises a plurality of backlight units, wherein each of the plurality of backlight units comprises three light sources each of which emits red light, green light, or blue light, and wherein the three light sources are aligned triangularly.

12. The driving method of a liquid crystal display device according to claim 7, wherein the liquid crystal display device comprises a plurality of backlight units, and wherein each of the plurality of backlight units comprises an organic light-emitting diode.

* * * * *